United States Patent [19]

Phillips

[11] Patent Number: 4,550,462

[45] Date of Patent: Nov. 5, 1985

[54] SHOE APPARATUS AND METHOD

[76] Inventor: Donald W. Phillips, Chateau Perigood 1 (45 D) 6 Laceto St. Leon, Monte Carlo, Monaco

[21] Appl. No.: 307,249

[22] Filed: Sep. 30, 1981

[51] Int. Cl.[4] ..... A43D 87/00; A43D 89/00; A43D 95/22

[52] U.S. Cl. ..... 12/17 R; 12/33; 12/38; 12/76.5; 12/85; 12/142 T; 12/142 Q; 219/215

[58] Field of Search ..... 12/33, 33.2, 17 R, 142 T, 12/142 Q, 38, 85, 88, 86.7, 76.5; 219/215

[56] References Cited

U.S. PATENT DOCUMENTS

| | | | |
|---|---|---|---|
| 282,857 | 8/1883 | Dean | 12/88 |
| 399,153 | 5/1889 | Noble | 12/88 |
| 627,840 | 6/1899 | Butterfield . | |
| 1,779,081 | 10/1930 | Baird | 12/38 |
| 2,129,437 | 9/1938 | Myers . | |
| 2,162,554 | 6/1939 | Johnson . | |
| 2,221,880 | 11/1940 | Pratt et al. . | |
| 2,285,398 | 6/1942 | Amico . | |
| 2,311,325 | 2/1943 | Anderson | 12/38 |
| 2,386,920 | 10/1945 | Knowlton . | |
| 2,497,195 | 2/1950 | Woodman et al. | 12/38 |
| 2,582,464 | 1/1952 | Small | 219/215 |
| 2,619,661 | 12/1952 | Hart . | |
| 2,694,131 | 11/1954 | Carson | 12/33.2 |
| 2,766,467 | 10/1956 | Juhola et al. . | |
| 3,102,286 | 9/1963 | Mimck | 12/33.2 |
| 3,256,421 | 6/1966 | Card | 219/215 |
| 3,483,581 | 12/1969 | Chandler et al. . | |
| 3,483,582 | 12/1969 | Morgan . | |
| 3,512,197 | 5/1970 | Carr, Sr. . | |

FOREIGN PATENT DOCUMENTS

| | | | |
|---|---|---|---|
| 1120932 | 12/1961 | Fed. Rep. of Germany | 12/88 |
| 182257 | 11/1922 | Switzerland | 12/88 |
| 529533 | 11/1940 | United Kingdom | 12/38 |

*Primary Examiner*—Werner H. Schroeder
*Assistant Examiner*—Steven N. Meyers
*Attorney, Agent, or Firm*—Nilsson, Robbins, Dalgarn, Berliner, Carson & Wurst

[57] ABSTRACT

An apparatus and method for applying an adhesive coated wear portion to the underside of a shoe wherein the wear portion and the underside of the shoe are heated, a first pressure is applied to urge the wear portion and the shoe together, and a second greater pressure is applied in situ to further urge the wear portion and the underside of the shoe together. In one embodiment, a heating element may be provided for transfer between a first location for heating and drying a shoe and a second location directly between the shoe and the wear portion to be applied. The periphery of the wear portion may be trimmed to correspond to the underside of the shoe.

67 Claims, 26 Drawing Figures

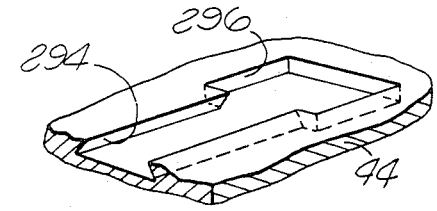
FIG. 25
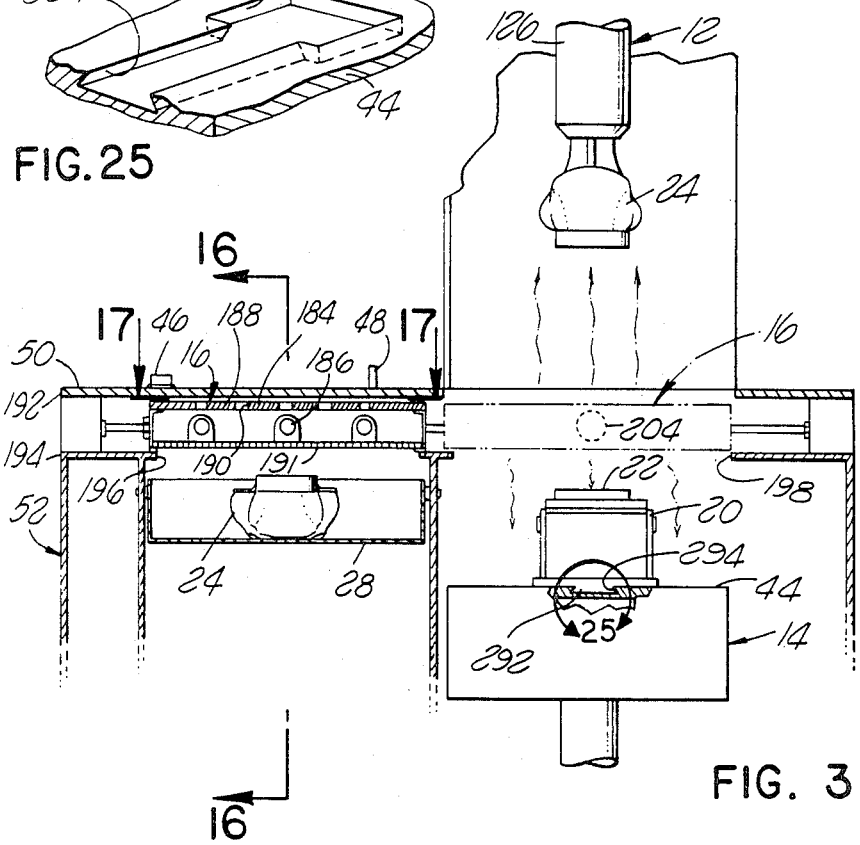
FIG. 3
FIG. 17
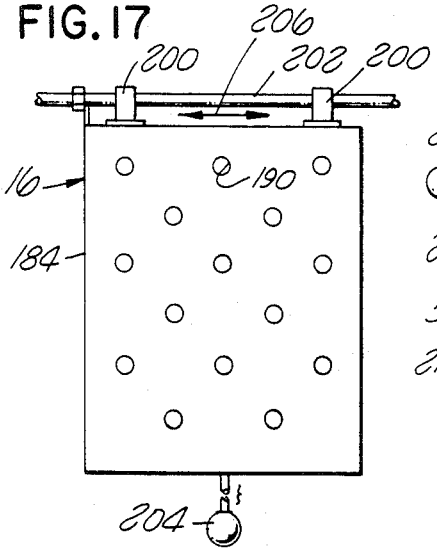
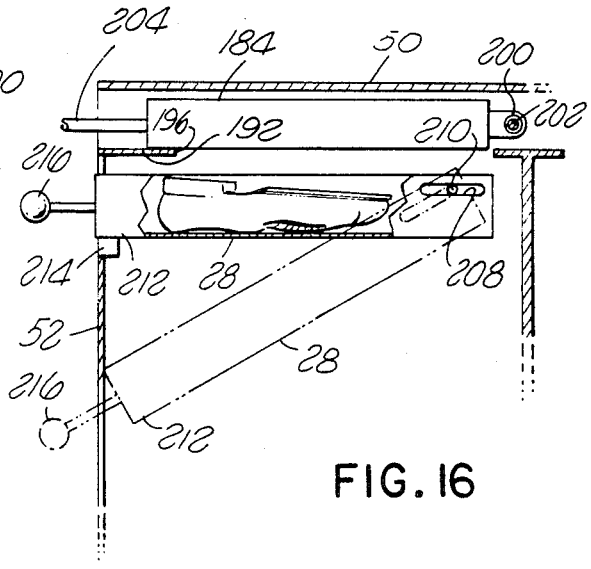
FIG. 16

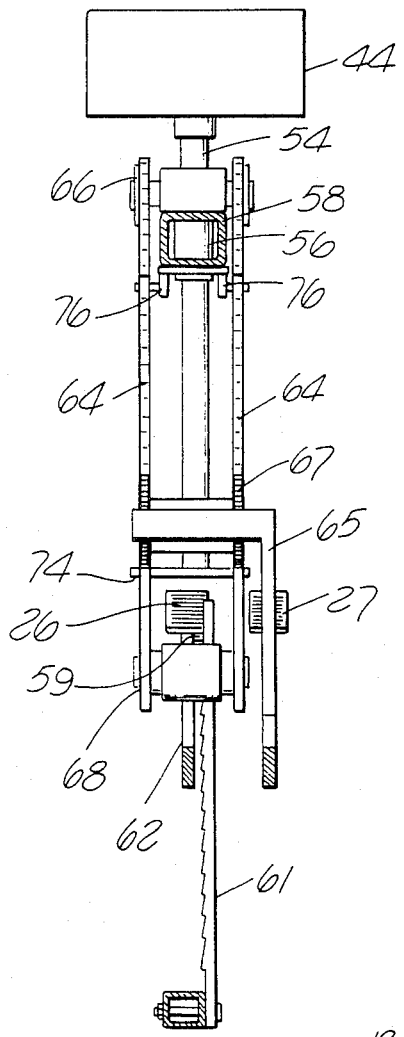
FIG. 5
FIG. 6
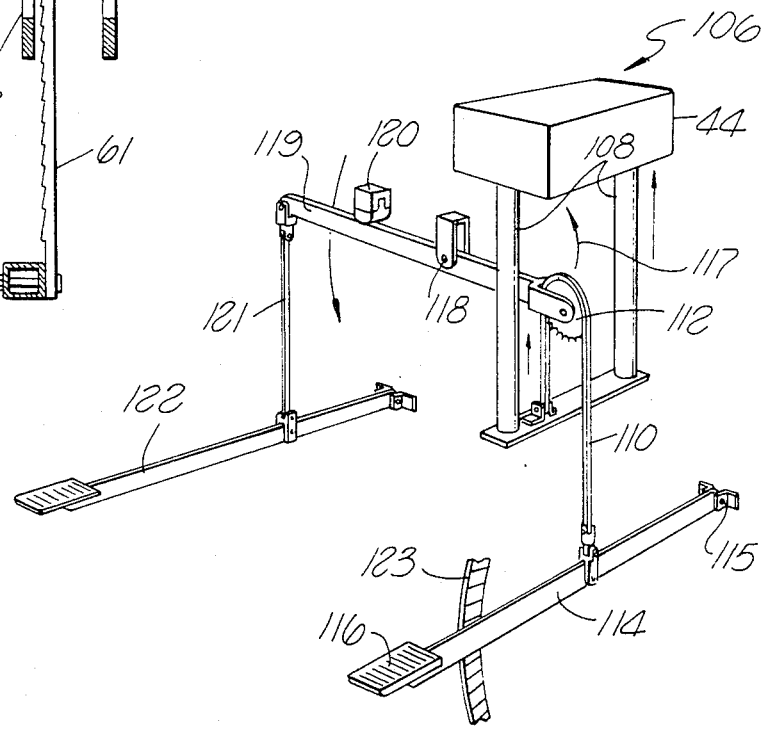

FIG. 7
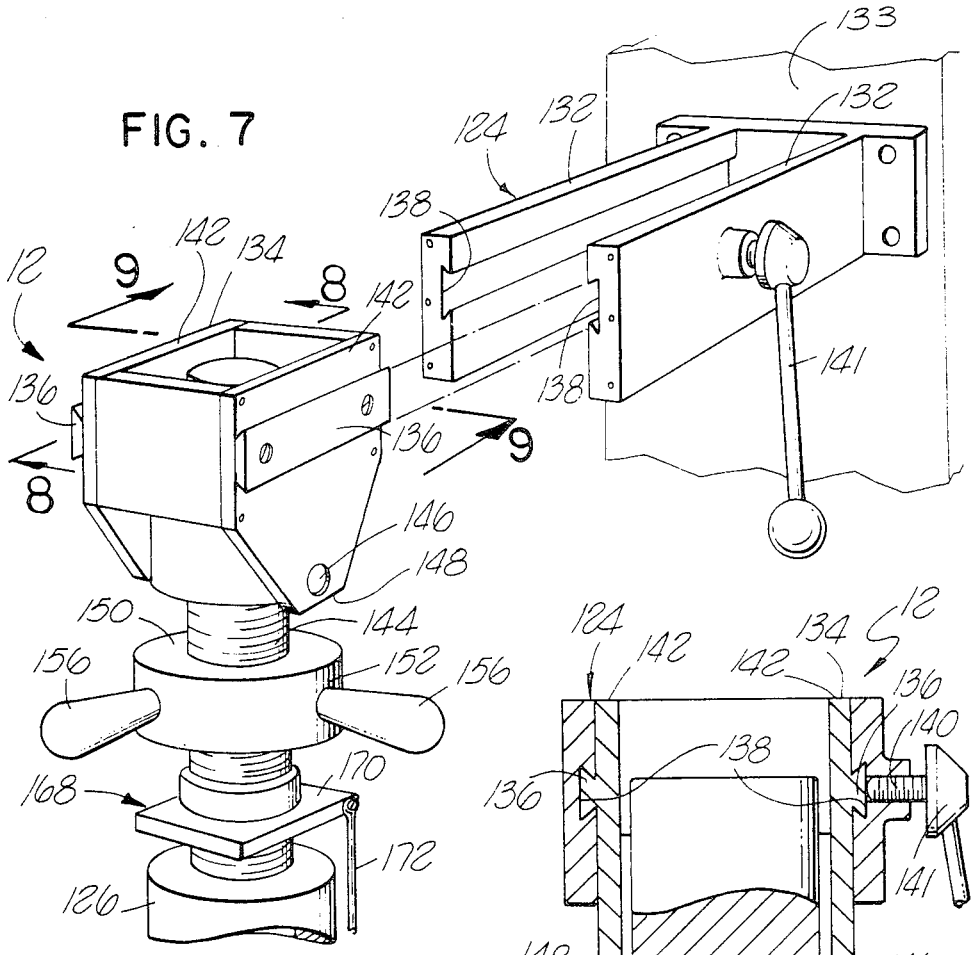
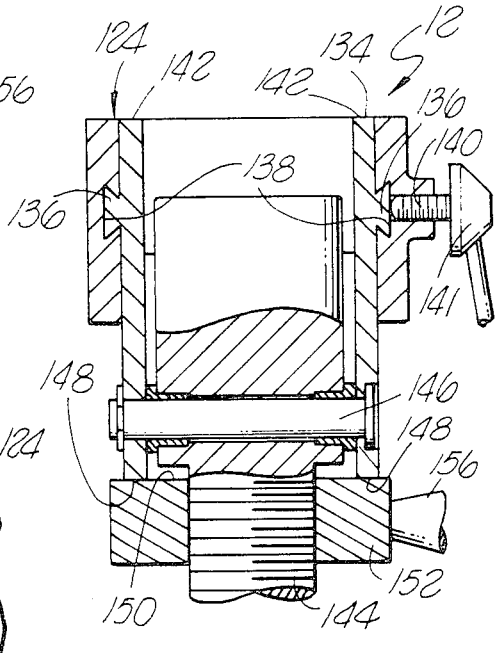
FIG. 9
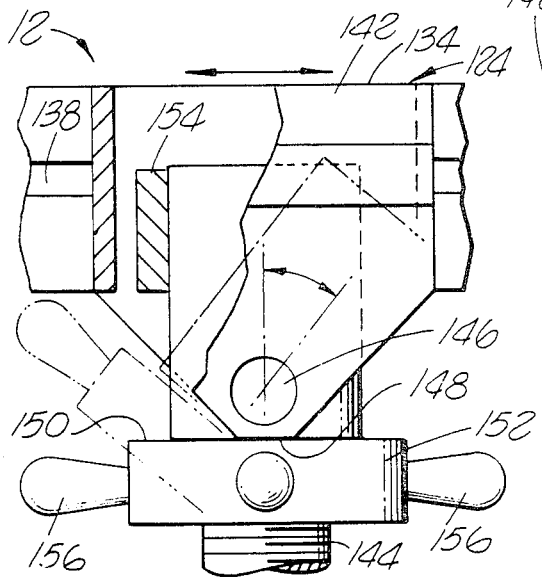
FIG. 8

FIG. 10
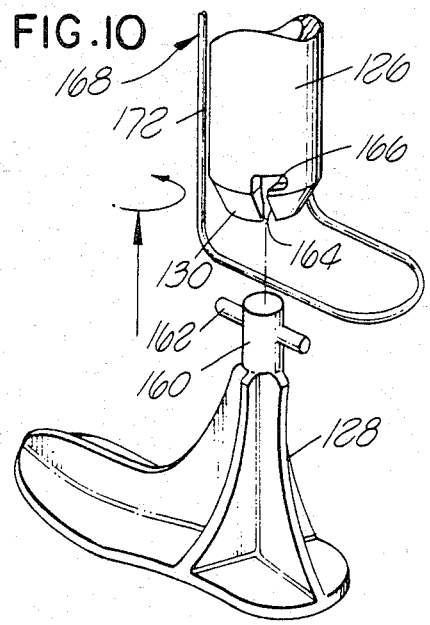
FIG. 11
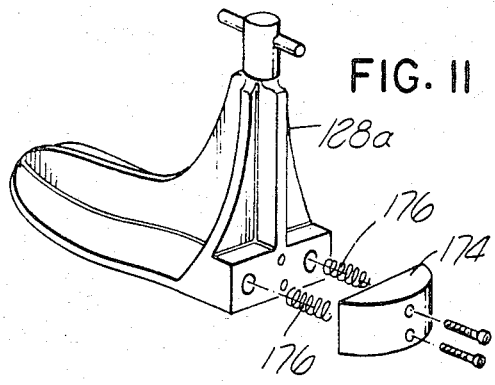
FIG. 13
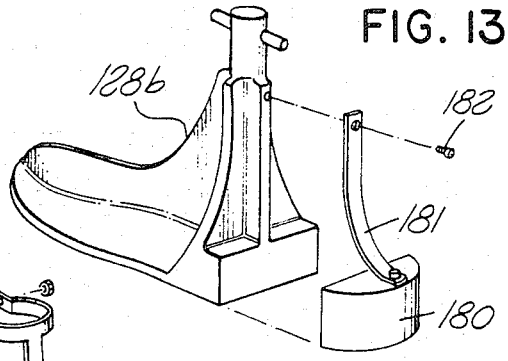
FIG. 14
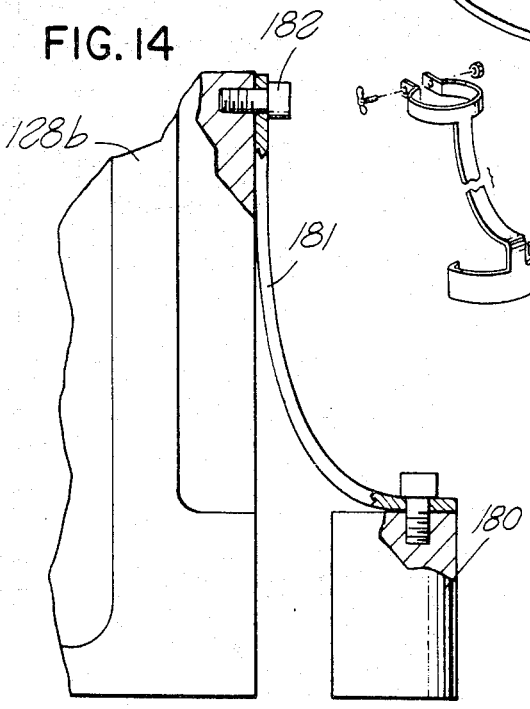
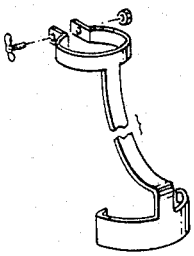
FIG. 15
FIG. 12
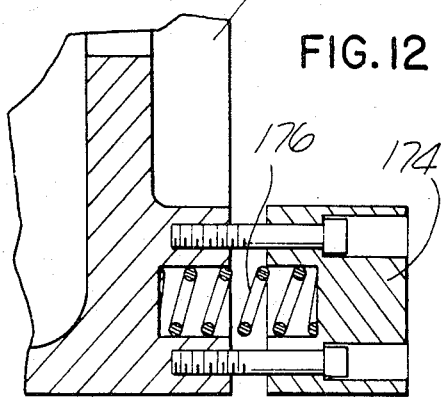

SHOE APPARATUS AND METHOD

RELATED APPLICATION

The present invention is related to a copending United States Patent application entitled "Shoe Sole" and identified as Ser. No. 307,250, now U.S. Pat. No. 4,445,285, May 1, 1984, in which the Applicant herein is the sole inventor. That application was filed concurrently herewith and discloses a specific type of wearing portion useful with the apparatus and method of the present invention. Its teachings are hereby incorporated by reference.

BACKGROUND OF THE INVENTION

This invention relates to the construction and repair of footwear and, more particularly, to an improved system for applying new soles and top lifts to shoes.

A number of machines have been proposed for the application of either soles or top lifts to shoes. However, such machines have generally been both bulky and expensive, and have required a substantial level of skill on the part of an operator. Shoe repair with the prior machines has thus involved substantial labor and capital costs, causing the cost of repairing a shoe to approach the purchase price of the shoe.

The following U.S. patents disclose shoe construction or repair machines having many of the characteristics described above: Pratt et al. U.S. Pat. No. 2,221,880; Hart, U.S. Pat. No. 2,619,661; Juhola et al. U.S. Pat. No. 2,766,467; and Morgan, U.S. Pat. No. 3,483,582. Each of the disclosed machines is a power operated machine of substantial complexity and cost. The machine of Hart U.S. Pat. No. 2,619,661 is a complex pneumatically operated press using high frequency electromagnetic radiation to activate a cement compound. Similarly, Juhola et al. U.S. Pat. No. 2,766,467 discloses a rather complex hydraulic press incorporating a magnetron oscillator for producing dielectric heat seam bonding of a shoe sole to a shoe.

Morgan U.S. Pat. No. 3,483,582 discloses a power operated mechanism for heating a shoe sole and the underside of a shoe, and thereafter applying the sole to the shoe. The sole is placed on the shoe at a first location and then moved laterally to a second location for the application of pressure thereto. U.S. Pat. No. 3,483,582 to Morgan also vaguely refers to an alternative arrangement wherein a portion of the disclosed structure is replaced by the pressure members of a sole attaching press.

While a number of less complex devices have been proposed, the ones known to applicant are generally capable of applying only relatively low levels of bonding pressure to a shoe. Devices of this type are disclosed in the following U.S. patents: Butterfield, U.S. Pat. No. 627,840; Myers U.S. Pat. No. 2,129,437; Johnson U.S. Pat. No. 2,162,554; Amico U.S. Pat. No. 2,285,398; Knowlton U.S. Pat No. 2,386,902; Chandler et al. U.S. Pat. No. 3,483,581; and Carr U.S. Pat. No. 3,512,197. Aside from the Butterfield and Carr patents, each of the disclosed devices is manually operated. However, the manual operating mechanisms of the devices are capable of generating only relatively low pressures urging a shoe sole against a shoe. The Myers and Knowlton devices apply pressure through simple toggle assemblies, while the Johnson and Amico devices use simple direct acting foot operated levers.

Therefore, it is desirable to provide a machine which is inexpensive and can be easily operated by an unskilled worker to securely fasten a wear portion to the underside of a shoe.

SUMMARY OF THE INVENTION

The present invention comprises an apparatus for applying a wear portion to the underside of a shoe, comprising: means for receiving a shoe; means for locating an adhesive-coated wear portion in an initial position relative to the shoe, with the adhesive coating essentially opposite to and spaced from the underside of the shoe; means for heating the underside of the shoe and the wear portion in the initial position; means for applying a first pressure to actuate the locating means and the shoe receiving means toward each other and urge the wear portion and the shoe together; and means for applying a second pressure in situ to further urge the wear portion and the underside of the shoe together, the second pressure being greater than the first pressure.

The apparatus may be manually operated and the locating means may comprise an actuating element mounted for reciprocal movement toward and away from the shoe receiving means and operatively connected to the first and second pressure means. The first pressure means may in turn comprise first lever means and means for transmitting tensile forces from the first lever means to the locating means. The first lever means may be actuable by a foot pedal and the force transmitting means may comprise at least one flexible force transmitting member operatively connected at one end thereof to the locating means.

The locating means is preferably mounted for movement from the initial position toward the shoe receiving means, with the first lever means engaging the flexible force transmitting member at a location remote from the one end thereof. The first lever means may engage the flexible force transmitting member in a manner decreasing the effective length of the member and thus increasing the tensile forces thereon.

The second pressure means may include means for deflecting a portion of the flexible force transmitting member laterally from a substantially linear tensioned condition to urge the locating means and the shoe receiving means together. The deflecting means may comprise second lever means. Alternatively, the second pressure means may comprise second lever means having first and second end portions and rotatable means mounted to the first end portion for guiding the flexible force transmitting member as it is tensioned by the first lever means. The second lever means is then actuable to effectively shorten the flexible member by altering the location of the rotatable means. In either case, the flexible force transmitting member may comprise a chain and the rotatable means may comprise an idler sprocket.

The shoe receiving means may comprise anvil means, shoe last means and means for mounting the shoe last means to the anvil means in a stationary upright condition to resist upward forces. The shoe last means may be mounted for sliding adjustment relative to the anvil means in a horizontal direction, and the mounting means may include a elongated support means depending from the anvil means and carrying the shoe last means at a lower end thereof. The elongated support means may be mounted for pivotal movement relative to the anvil means between the stationary upright condition of the shoe last means and a second condition in which the shoe last means is swung outwardly therefrom.

The heating means may comprise a heating element transferrable between first and second positions, the heating element being positioned between and substantially parallel to the underside of the shoe and the wear portion in the second position of the heating element. The heating means may comprise handle means for manually tranferring the heating element between the first and second positions, and means for guiding the heating element.

The apparatus may include means for initially heating a shoe to facilitate removal of a previously applied wear portion, comprising tray means for holding the shoe and exposing it to the heating element in the first position thereof. The tray means may be located below the heating element in the first position and actuable between a lowered condition permitting access to a shoe therein and a raised condition in which the shoe is located closer to the heating element. The heating means may include asbestos or other protective means carried with the heating element for avoiding contact of the user's hand with the heating element.

The locating means may comprise a pad assembly having an upper pad portion pivotable within a preselected range from the horizontal to assume an orientation substantially parallel to a portion of the underside of the shoe. The pad portion may further comprise resilient means below the upper pad portion for biasing that portion toward a preselected orientation relative to a base. Alternatively, the locating means may comprise a pad assembly having a rigid base layer, a first resilient layer overlying the base layer and a second resilient layer overlying the first layer. The first layer preferably has a greater resistance to compression than the second layer, and the second layer defines an upper contacting surface having a contour which corresponds to the shape of the underside of the shoe. The contoured surface may be produced by a curvature of the rigid base layer or by at least one element of nonuniform thickness between the base layer and the second layer. The element of non-uniform thickness may comprise one or more tapered or wedge-shaped elements.

The apparatus may include means for trimming the wear portion after it is applied to the shoe. The trimming means comprises an outer working surface of the apparatus, rotary cutter means extending at least partially through the working surface in an outward direction for engagement with the wear portion of the shoe, means for mounting the cutter means for rotation relative to the working surface and means for connecting a rotary drive source to the cutter means. The trimming means may include bearing means concentric with the cutter means and located outwardly therefrom, the bearing means engaging the shoe at a location above the wear portion to guide the shoe relative to the cutter means as the cutter means rotates. The bearing means is essentially coextensive in a radial direction with the cutter means and is mounted thereto. The means for mounting the cutter means may include means for adjusting the position of the cutter means relative to the working surface in a direction normal to the working surface. The means for connecting a rotary drive source preferably comprises belt and pulley means connectible to flexible drive means.

The method of the present invention comprises essentially the method practiced with the disclosed apparatus. It includes the steps of positioning a shoe and an adhesive-coated wear portion in opposing relationship, with the adhesive coating facing the underside of the shoe and spaced therefrom; heating the underside of the shoe and the wear portion; applying a first pressure to actuate the wear portion and the shoe toward each other and urge them together; and thereafter applying a second presure in situ to further urge the shoe and the wear portion together, the second pressure being greater than the first pressure. The steps of applying the first and second pressures may be performed manually, and the step of heating the underside of the shoe and the wear portion includes transferring a heating element from a first remote location to a second location between the shoe and the wear portion. The method may further comprise the initial step of heating the shoe by placing it adjacent the heating element at the first location. This initial heating serves to dry the underside of the shoe and to soften any adhesive holding a previously applied wear portion thereto.

The apparatus and method of the present invention provide an extremely simple yet effective system for applying a wear portion to the underside of a shoe. The operation can be performed either in the initial construction of the shoe or at any time thereafter, for the purpose of extending the useful life of the shoe. When a shoe is purchased new, for example, the purchaser may wish to have an additional wear portion applied according to the present invention to greatly increase the wearability of the shoe sole. It is, however, contemplated that the system of the present invention will be used more commonly in the repair of a shoe having a sole or top lift (heel) which is unduly worn. The simplicity and relatively low cost of the apparatus of the present invention make it feasible to provide the apparatus at a wide variety of locations, and permit the apparatus to be used by persons having no particular skill or technical training in the shoe repair art. For example, the machine can be placed at shoe stores or department stores and operated by unskilled sales personnel. Because the repair operation can be accomplished in as short a time span as five minutes, a customer's shoes can be repaired while he waits and without consuming an undue amount of the salesman's time.

A number of structural features of the apparatus of the present invention make it uniquely suited for rapid and efficient operation by unskilled labor. The mechanism for bringing a wear portion into contact with a shoe and for urging the two together with a force sufficient to produce adequate bonding has been accomplished in the present invention with a dual pressure arrangement. The dual pressure arrangement may include a foot pedal mechanism permitting force to be applied at two distinct conditions of leverage, corresponding to two levels of pressure on the wear portion and the shoe. The first condition of leverage permits the wear portion to be moved rapidly into abutment with the shoe, while the second condition of leverage permits a high pressure to be applied manually through a foot pedal. The position of the wear portion relative to the shoe and the pressure applied to the wear portion and the shoe are thus easily controlled by the operator while his hands remain free for other tasks.

The heater arrangement of the present invention is also extremely simple to operate and produces a highly versatile system. The heater is initially positioned at a first location remote from the wear portion and the actuating mechanism. The wear portion can then be raised by the actuating mechanism to a position abutting the underside of the shoe for the purpose of precisely aligning the wear portion relative to the shoe. During this step, the heater can be operating to heat and dry another shoe. When the wear portion has been correctly aligned, it is retracted from the area of the shoe by the actuating mechanism and the heater is transferred to a second location therebetween. At this time, the heater is activated through an automatic timing mechanism to provide intense heat for approximately 10 seconds to both melt the adhesive coating on the wear portion and heat the underside of the shoe. This initial heating period is preferably followed by a period of between one and two minutes, during which the heater provides a lower level of heat suitable for maintaining the adhesive in the melted condition and keeping the underside of the shoe hot. The period of lower heat maintains the elements in condition for bonding in case the operator is momentarily occupied with another activity. When the heater is turned off by the timer, it is simply transferred back to its initial location and the wear portion is applied to the shoe by the dual pressure arrangement described above. Due to the substantial bonding pressure provided by the dual pressure arrangement, full bonding can be achieved in as little as 10 seconds.

After bonding, any part of the wear portion which extends beyond the periphery of the underside of the shoe can be readily removed with the trimming mechanism of the present invention. The shoe is simply slid along an outer surface of the apparatus with the edge of the shoe sole pressed against the rotary cutter. As the cutter removes unwanted material from the wear portion, the sole or other portion of the shoe directly above the wear portion comes into contact with the bearing mounted to the cutter. One contact is made between the shoe and the bearing at a particular point, the cutter will remove no more material from that point. The rotary cutter thus serves to remove only the parts of the wear portion extending outwardly beyond the shoe sole. In this context, even an unskilled operator can produce a smoothly trimmed wear portion by simply guiding the periphery of the shoe along the cutter.

A number of other features further contribute to the simple and safe operation of the system of the present invention by unskilled workers. For example, the last assembly which holds the shoe during the heating and pressure application steps may be mounted for sliding movement in a horizontal direction relative to the actuating mechanism and for pivotal movement upwardly and outwardly from the remainder of the apparats. The position of the shoe relative to the actuating mechanism can therefore be adjusted fore and aft by an operator and the shoe can be readily mounted to and removed from the last arrangement by swinging it outwardly from the apparatus.

The upper side of the heater is provided with a protective cover of asbestos or other suitable material having openings for the transfer of heat therethrough. The asbestos cover prevents an operator from burning himself by inadvertently contacting the heating element with his hands, protects the heating element from damage caused by objects falling on it, and limits the amount of heat reaching the shoe to a level which will not adversely affect the shoe.

In addition, the method of operation of the apparatus minimizes the possibility of injury to even an unskilled operator, since it is unecessary for him to handle the heated wear portion in any way prior to its application to the shoe. Alignment of the wear portion is accomplished prior to heating, and the step of actuating the wear portion toward the shoe is accomplished with the foot operated pressure mechanism.

Another advantage of the present invention is the fact that it is a single compact unit on which the entire shoe repair process can be performed. The large number of specialized and rather complex machines used in conventional shoe repair systems occupy several times the space occupied by the system of the present invention. This feature permits the system to be located and used at a wide variety of locations, such as retail shoe stores and department stores, without interfering with the other activities taking place there. Conventional shoe repair machinery would not be feasible at such locations from the standpoint of space allocation, capital investment or operating personnel.

Finally, the apparatus and method of the present invention are much more suitable for use in highly trafficked areas than is conventional shoe repair equipment, from the standpoints of cleanliness and health. Much less debris is produced and the hot melt glue used is nontoxic, unlike many prior shoe adhesives.

BRIEF DESCRIPTION OF THE DRAWINGS

The above and other objects of the present invention may be more fully understood from the following detailed description taken together with the accompanying drawings wherein similar reference characters refer to similar elements throughout and in which:

FIG. 3 is a somewhat diagrammatic fragmentary vertical sectional view taken along the direction 3—3 of FIG. 1, showing the heater arrangement of the present invention in full lines at a first location thereof and in phantom lines at a second location;

FIG. 5 is a fragmentary vertical sectional view taken along the line 5—5 of FIG. 4;

FIG. 6 is a schematic diagram of an alternative embodiment of the actuating mechanism illustrated in FIGS. 4 and 5;

FIG. 7 is a fragmentary exploded perspective view showing the upper portion of the shoe mounting arrangement.

FIG. 8 is a vertical sectional view taken in the direction 8—8 of FIG. 7;

FIG. 9 is a vertical sectional view taken in the direction 9—9 of FIG. 7;

FIG. 10 is a fragmentary exploded perspective view showing the lower portion of the shoe mounting arrangement of the apparatus of FIG. 1;

FIG. 11 is an exploded perspective view of a last arrangement constructed in accordance with a preferred embodiment of the present invention;

FIG. 12 is a fragmentary vertical sectional view of the heel portion of the last arrangement of FIG. 11;

FIG. 13 is an exploded perspective view of a last arrangement constructed in accordance with another embodiment of the present invention;

FIG. 14 is a fragmentary vertical sectional view, partially broken away, of the heel portion of the last arrangement of FIG. 13;

FIG. 15 is a perspective view of a shoe locating element constructed in accordance with a further embodiment of the present invention.

FIG. 16 is a somewhat diagrammatic vertical sectional view taken along the line 16—16 FIG. 3;

FIG. 17 is a somewhat diagrammatic fragmentary horizontal sectional view taken along the line 17—17 of FIG. 3;

FIG. 25 is a fragmentary perspective view of an end of a retaining groove of a press pad constructed in accordance with the present invention.

DESCRIPTION OF THE PREFERRED EMBODIMENTS

Figure 1:
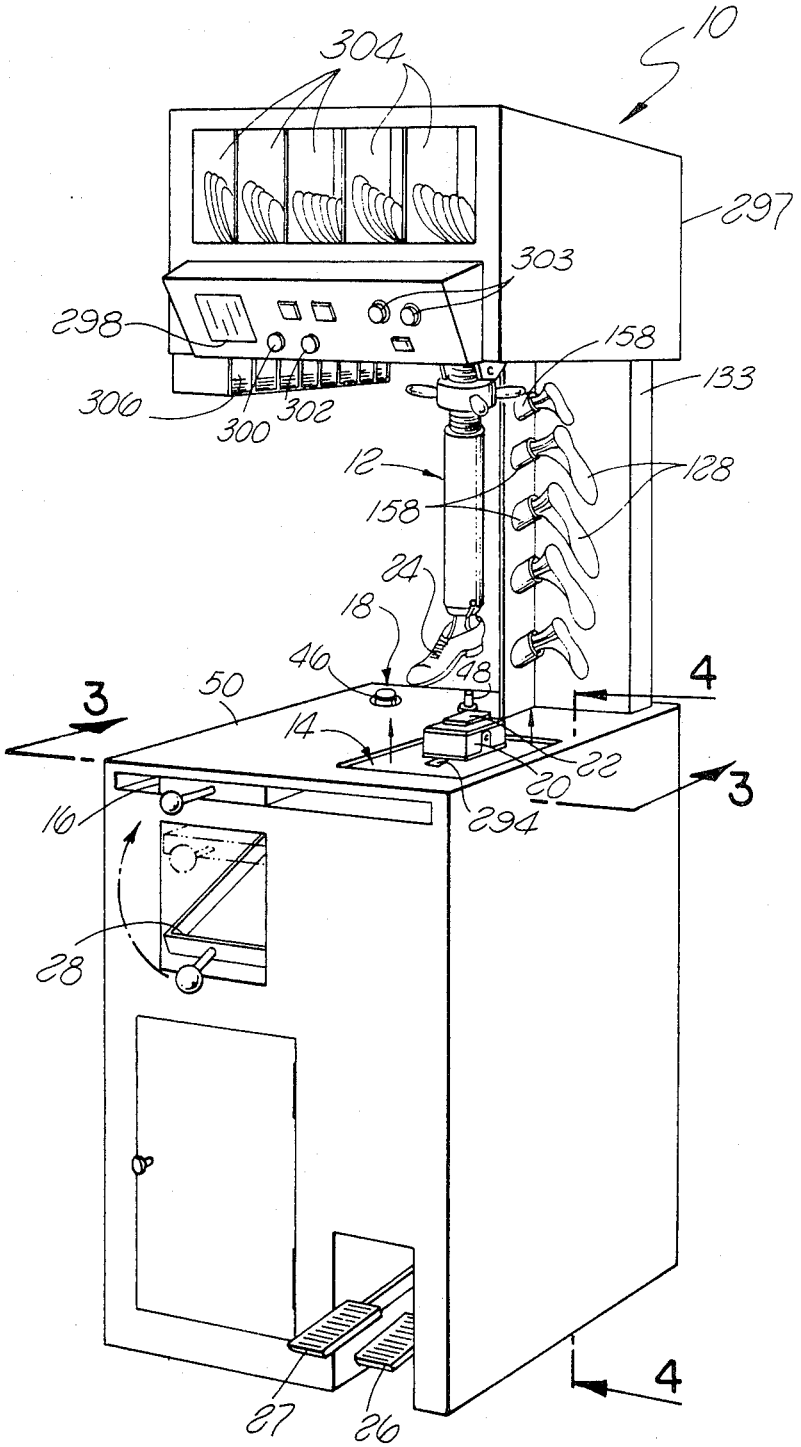
FIG. 1 is perspective view of an apparatus constructed in accordance with the present invention.

Referring now to the drawings, there is illustrated in FIG. 1 an apparatus constructed in accordance with the present invention, generally designated 10. The apparatus 10 comprises generally a shoe mounting arrangement 12, an actuating mechanism 14 located beneath the shoe mounting arrangement, a heater arrangement 16 and a trimming mechanism 18. A pad assembly 20 is actuable upwardly by the mechanism 14 to urge a wear portion 22 on the pad assembly against the underside of a shoe 24 depending from the mounting arrangement 12. As described below, actuation of the pad assembly 20 and the wear portion 22 against the shoe 24 is accomplished in two phases. In the first phase, a first pressure is applied through a foot pedal 26 to move the wear portion 22 quite rapidly toward the shoe 24. This movement is preferably accomplished at a first condition of leverage. When the wear portion has been moved sufficiently to substantially abut the underside of the shoe 24, a second pressure is applied through a second foot pedal 27 to urge the wear portion upwardly against the shoe. Application of the second pressure is preferably accomplished at a second condition of leverage. The second pressure is substantially greater than the first pressure to achieve optimal bonding of the wear portion 22.

The heater arrangement 16 is mounted for transfer between a first location, shown in full lines in FIG. 3, and a second location shown in broken lines. When positioned at the first location, the heater arrangement 16 is substantially above a tray 28 for heating and drying the shoe 26. At the second location, the heater arrangement 16 is positioned directly between the wear portion 22 and the shoe 24 for melting a coating of hot melt adhesive on the wear portion 22 and heating the underside of the shoe 24 in preparation for bonding.

Figure 2:
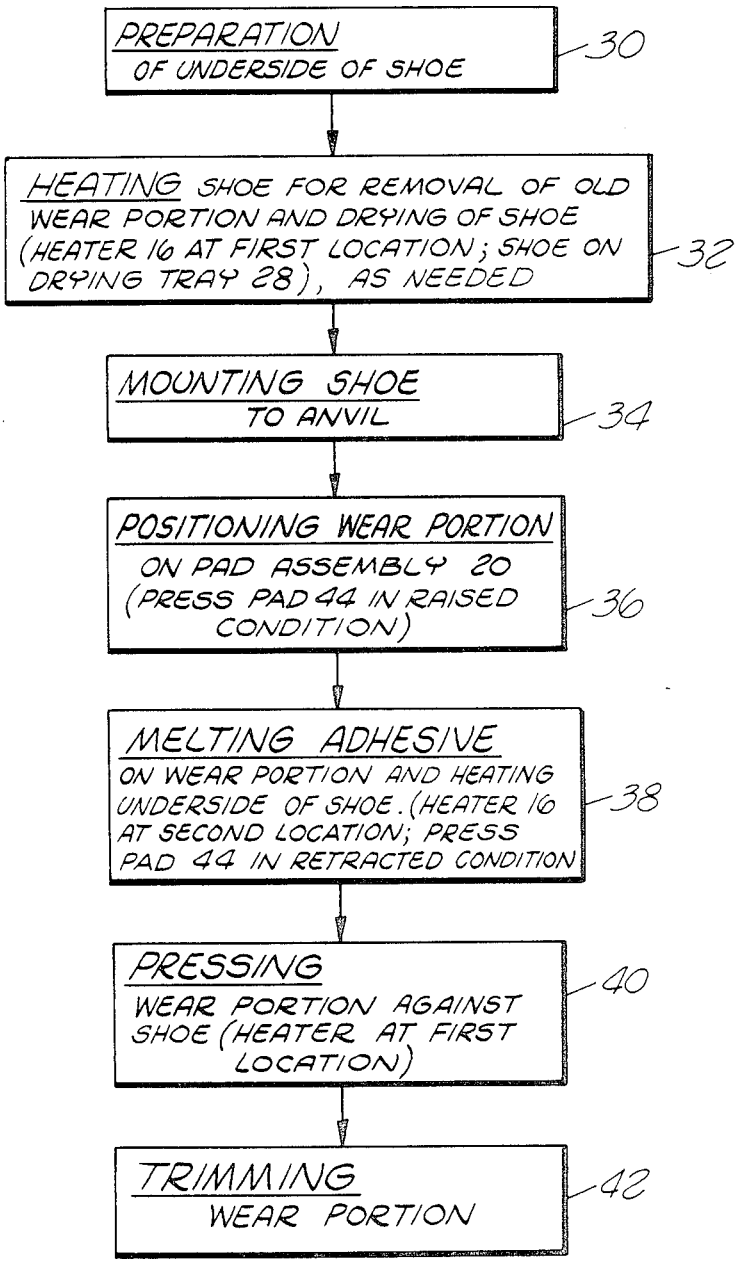
FIG. 2 is a block diagram of a number of steps useful in the method of the present invention.

The general operation of the apparatus 10 is illustrated in the flow diagram of FIG. 2. Steps 30 through 42 are depicted in sequence, the first being the general step 30 of preparing the underside of the shoe. The underside of the shoe is generally cleaned and inspected at this time.

The shoe is then heated and dried, as shown at 32, with the heater arrangement 16 positioned at the first location and the shoe positioned on the tray 28. If a wear portion has previously been applied to the shoe with an adhesive, the adhesive is melted by this step so that the old wear portion can be removed before a new one is applied. For these purposes, the shoe 24 will usually be positioned in the upside down position of FIGS. 1 and 3 with the sole of the shoe facing the heatr arrangement 16.

After the shoe has been throughly dried and any prior adhesively applied wear portion has been removed, the shoe is mounted to the shoe mounting arrangement 12 as shown at step 34. With the shoe mounted, the wear portion to be applied is positioned on the pad assembly 20 according to the step 36. For this purpose, a press pad or actuating element 44 of the actuating mechanism 14 is raised to place the wear portion against the shoe 24. The wear portion can then be accurately aligned relative to the shoe so that it will subsequently be bonded to the desired location thereon. The actuating mechanism is then retracted to lower the press pad 44 and the wear portion 22 to the position shown in FIG. 3.

The heater is then transferred to the second location for simultaneously melting the adhesive coating of the wear portion and heating the underside of the shoe (step 38). After a preselected melting time, the heater is returned to the first location according to the step 40 and the mechanism 14 raises the wear portion 22 and presses it against the shoe in the two phases described above. The second pressure between the wear portion and the shoe is maintained for a preselected length of time, preferably on the order of 10 seconds.

During the steps 32 and 34, the heater arrangement 16 is actuable to produce an intense level of heat for approximately 10 seconds, followed by a lower level of heat for an adjustable time period of between one and two minutes. In the step 34, the intense heat melts the adhesive coating on the wear portion 22 and heats the underside of the shoe. The lower heat maintains the wear portion and the shoe in condition for bonding until the operator is prepared to proceed. A one to two minute grace period is thus provided in the step 34, permitting the operator to carry on more than one activity without allowing the adhesive and the shoe to cool to a point at which the intense heat cycle would have to be repeated.

Finally, the material of the wear portion extending beyond the peripheral edge of the shoe 24 can be removed with the trimming mechanism 18 of FIG. 1 (step 42). The trimming mechanism 18 includes a rotary cutter 46 and a drive spindle 48 extending outwardly through a working surface 50 of the apparatus 10. The rotary cutter and drive spindle are connected for common rotation at a point below the working surface 50, the drive spindle 48 being connectible to a rotary drive source (FIG. 18) through a flexible drive arrangement or other suitable means. The rotary cutter 46 is rotated relative to the surface 50, permitting excess material to be removed from the newly applied wear portion 22 when the shoe 24 is moved therepast.

Figure 4:
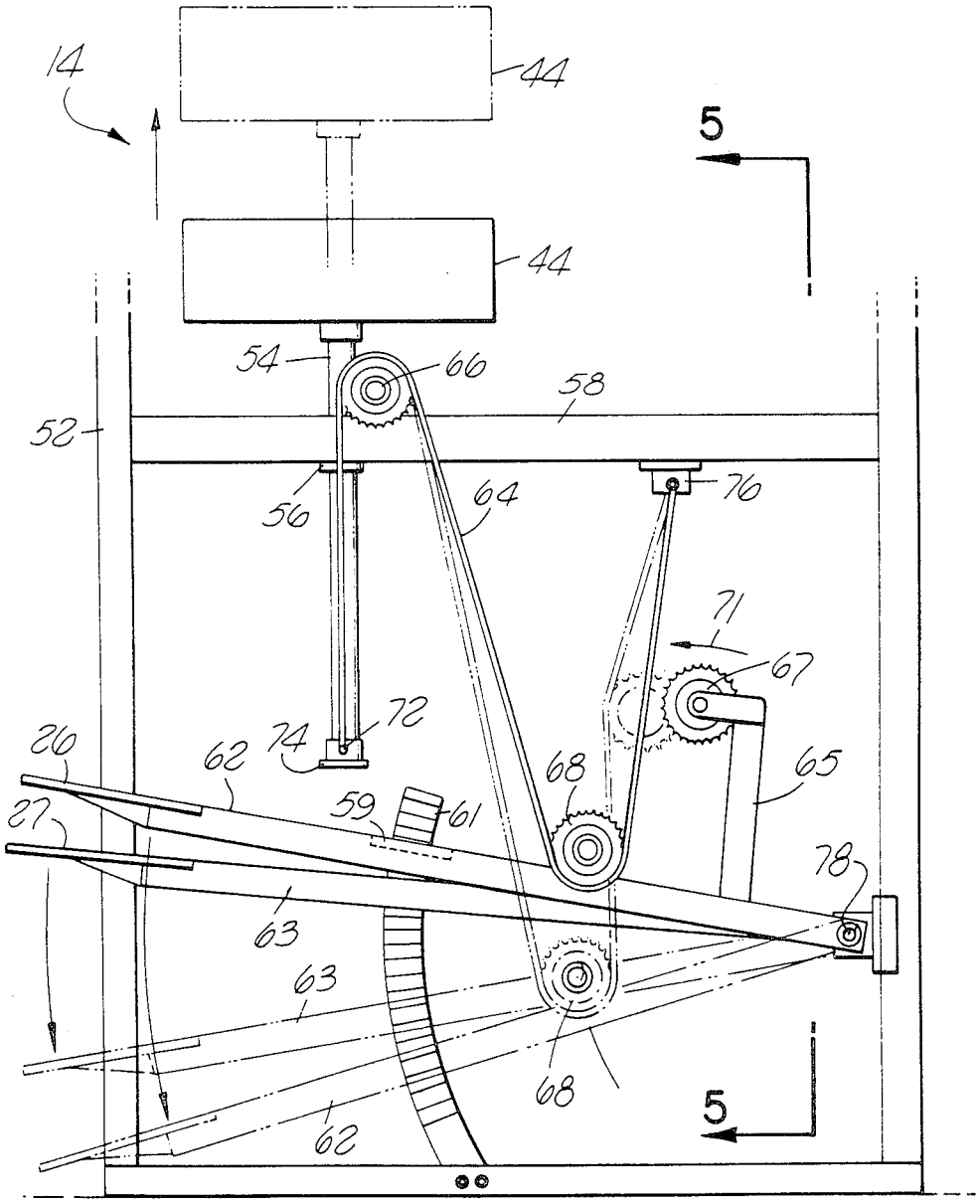
FIG. 4 is a fragmentary diagrammatic vertical sectional view taken in the direction 4—4 of FIG. 1 and illustrating an actuating mechanism constructed in accordance with the present invention.

Referring now to FIGS. 4 and 5, the bulk of the actuating mechanism 14 is located within a lower housing 52 of the apparatus 10. The press pad 44 of the mechanism 14 is mounted to the upper end of a vertical shaft 54 which is slidingly received within a sleeve 56. The sleeve 56 is fixedly mounted to a cross member 58 of the housing 52 to guide the shaft 54 and thus the press pad 44 vertically between the retracted full line condition FIG. 4 and the raised broken line condition thereof.

The first pressure is applied to the press pad 44 by a lever structure 62 acting through a pair of chains 64 and two sets of sprockets 66 and 68. The chains 64 extend from first ends 72 fixed to a flange 74 at the lower end of the shaft 54, to a pair of mounting brackets 76 which are fixed to the cross member 58. Between the flange 74 and the brackets 76, the chains pass upwardly beside the vertical shaft 54, over the sprockets 66 mounted to the cross member 58 and downwardly to the sprockets 68. From there, the chains 64 pass beneath the sprockets 68 and upwardly to the mounting brackets 76. The lever structure 62 carries the foot pedal 26 at one end thereof and is mounted to the lower housing 52 at the other end for pivotal movement about a horizontal axis 78. The sprockets 68 are carried by the lever structure 62 at a point intermediate the ends thereof, such that downward force on the lever structure 62 establishes a tensile force on the chains 64. Because each chain is anchored at one of its ends, the full tensile force along the chain will be applied at its outer end 72 to the flange 74. This force tends to raise the vertical shaft 54 and press pad 44. Stated somewhat differently, movement of the lever structure 62 in a downward direction shortens the effective length of the chain, causing the unfixed ends of the chain to move. Because the set of sprockets 68 is located between the foot pedal 26 and the pivot axis 78, a predetermined mechanical advantage or condition of leverage is achieved with the foot pedal.

The lever structure 62 is further provided with a pawl 59 which engages a ratchet structure 61 to hold the lever structure down after the pedal 26 has been depressed. The press pad 44 is thus held in a raised condition following application of the first pressure, until the pawl 59 is disengaged.

A second pressure is applied to the press pad 44 by a second lever structure 63 which acts on the chains 64 through a lever arm 65 and a set of idler sprocket 67. The lever structure 63 is located beside the structure 62 and is similarly mounted for rotation about the axis 78. The arm 65 extends generally upwardly from the structure 63 at a location adjacent the axis 78 and carries the sprocket 67 at an upper end thereof. The sprockets 67 are offset relative to the structure 63 to engage the chains at a location between the sprockets 68 and the brackets 76 when the structure 63 is depressed. Thus, depression of the structure 63 by stepping on the foot pedal 27 at one end thereof causes the sprockets 67 to move against the chains in the direction indicated at 71. The chains are thereby deflected laterally from the full line condition of FIG. 4 between the sprockets 68 and the brackets 76.

This "swigging" of the chains 64 serves to further tension the chains and draw the shaft 54 upwardly at an increased level of pressure. Due to the nature of the swigging operation, the leverage achieved is greater than that produced with the lever structure 62. The press pad 44 is thus raised in two phases. The first phase consists of applying a first pressure by depression of the lever structure 62 and the second phase consists of applying a second increased pressure by operation of the lever structure 63 after the structure 62 has been locked in the depressed condition.

The two phase pressure application achieved with the actuating mechanism 14 is highly significant in the context of the present invention. This feature, and particularly the dual leverage mechanism by which it is accomplished, permits a high pressure to be achieved between the wear portion 22 and the shoe 24 without the aid of a power apparatus. The first condition of leverage enables the press pad 44 to be moved the substantial distance between its retracted and raised conditions. Once the wear portion is raised to abut the underside of the shoe, however, the pressure achieved in the first condition of leverage is simply not sufficient to produce optimal adhesive bonding. A substantially greater pressure, achieved in the second condition of leverage, is then applied to fully activate the adhesive. The swigging mechanism of the second lever structure 63 thus acts as a secondary pressure application means or pressure booster.

FIG. 5 is a schematic representation of an alternative structure usable in place of the actuating mechanism 14 to achieve the above-described two phase pressure application. A mechanism 106 is depicted therein in relation to the press pad 44 and a pair of vertical shafts 108 similar to the shaft 54. The press pad and the shafts are actuated vertically by at least one chain 110 extending over a sprocket 112 and downwardly to a first lever arm 114. The chain 110 is connected to the lever arm 114 at a location between a pivot point 115 and a foot pedal 116 thereof, permitting tensile forces to be applied to the chain by downward movement of the foot pedal 116. These tensile forces are applied to the vertical shafts 108 at a first condition of leverage similar to that obtained with the lever structure 62 of the actuating mechanism 14.

Unlike the actuating mechanism 14, the sprocket 112 of the mechanism 106 is itself pivotable in the direction indicated at 117 about an axis 118 spaced from the axis of the sprocket. The sprocket is pivoted about the axis 118 by a second lever arm 119 which extends beyond the axis 118 in a direction away from the sprocket 112. Pivotal movement of the arm 119 in the opposite direction is limited by the stop 120. The remote end of the second lever arm 119 is connected to a second chain 121 which is actuable downwardly by a third lever arm 122. Once the press pad 44 is raised to the desired height by actuation of the first lever arm 114, the lever arm 114 is locked in a depressed condition by a ratchet mechanism 123 and the chain 110 is further tensioned by depression of the third lever arm 122. The third lever arm 122 acts through the second lever arm 119 to raise the rotatable sprocket 112 and thus urge the press pad 44 upwardly at a greater pressure level. The configuration of the mechanism 106 actually serves to compound the leverage inherent in the second and third lever arms 119 and 122.

It will be understood that the above teachings as to the actuating mechanisms 14 and 106 are not limited to the use of chains and pulleys as force transmitting members. In fact, virtually any force application means could be used to achieve the dual pressure operation described herein. In the case where the force application means includes a flexible member, the member may, for example, be a conventional cable or belt.

The structure and operation of the shoe mounting arrangement 12 is shown most clearly in FIGS. 7 through 10. The shoe mounting arrangement 12 generally comprises an anvil structure 124 having an elongated support rod 126 depending therefrom. A shoe last structure 128 is carried at a lower end 130 of the support rod 126 for reception of a shoe.

The anvil structure 124 includes a pair of parallel vertical plates 132 extending forwardly at a location above the lower housing 52. The plates 132 are fixedly mounted relative to the housing 52 by a vertical rear panel 133 of the apparatus 10 (see FIG. 1). A carriage 134 is mounted for fore and aft sliding movement relative to the plates 132 by pairs of interfitting dovetail elements 136 and dovetail grooves 138. The carriage 134 may be locked in a desired location in the fore and aft direction by a set screw 140 threaded laterally through one of the plates 132 for engagement with the carriage 134. The set screw 140 is actuable by a handle 141.

The carriage 134 itself comprises a pair of spaced apart parallel plates 142 having a threaded shaft 144 sandwiched therebetween. The shaft 144 is journaled on a horizontal pivot pin 146 for pivotal movement within a plane parallel to the plates 142. As seen in FIGS. 7 through 8, the parallel plates 142 are provided with flat lower surfaces 148 engageable with an upper surface 150 of a nut 152 threaded upon the shaft 144.

When the nut 152 is threaded upwardly on the shaft 144 to cause engagement of the surface 148 with the surface 150, the shaft 144 is locked in the vertical full line condition of FIG. 8. In this condition, the shaft 144 directly above the pivot pin 146 abuts a stop element 154 mounted to the plates 142. When the nut 152 is threaded downwardly on the shaft 144, the shaft 144 is permitted to swing outwardly and upwardly to the broken line condition of FIG. 10, permitting ready access to the shoe last structure 128 and the shoe 24 received thereon. The nut 152 is provided with a plurality of radially extending handles 156 to facilitate manual threading of the nut 152 up and down along the shaft 144. When it is desired to return the shoe mounting arrangement 12 to the full line condition of FIG. 8, the shaft 144 is simply swung downwardly and rearwardly until the shaft contacts the stop element 154. The nut 152 is then spun upwardly along the shaft to engage the flat surface 148.

The elongated support rod 126 is threaded axially along the rod 144 a preselected distance to locate the shoe last structure 128 at a desirable height above the working surface 50. This height can therefore be adjusted to accommodate shoes and shoe lasts of varying vertical dimensions by simply rotating the support rod 126 relative to the shaft 144.

The apparatus of the present invention is preferably provided with a plurality of shoe last arrangements 128 adapted to receive shoes of varying sizes and types. The shoe last arrangements 128 may be stored upon the vertical rear panel 133 of the apparatus 10, as shown in FIG. 1. A plurality of holders 158 may be provided for this purpose.

Referring now to FIG. 10, the shoe last structures 128 are interchangeably mounted to the lower end 130 of the support rod 126 by a bayonet connection or other suitable means. Thus, the upper end 160 of each shoe last structure 128 is at least partially receivable within the lower end 130 such that a pair of opposed radial pins 162 thereof engage a pair of slots 164 in the support rod. The slots 164 are provided with undercut portions 166 permitting the pins 162 to be inserted axially to the base of the slots and then rotated through a small angle to lock the pins and thus the shoe last structure 128 against further axial movement. The shoe last structure 128 can be removed for exchange with another similar structure by simply rotating it back through the same small angle and withdrawing it axially from the support rod.

A number of different structures are illustrated in the drawings for retaining a shoe in the desired position on a particular last structure 128. For example, FIGS. 7 and 10 illustrate a shoe retaining arrangement 168 comprising a collar 170 and a resilient strap element 172 forming a loop extending generally downwardly therefrom. The collar 170 is threadingly received on the shaft 144 at a location between the nut 152 and the support rod 126. The strap 172 can be looped under a heel portion of the shoe 24 to draw the shoe upwardly and rearwardly relative to the shoe last. The toe of the shoe is thus drawn as far as possible over the toe of the last, causing the shoe to be more securely retained thereon.

Three other structures for accomplishing this purpose are illustrated in FIGS. 11 through 15. FIGS. 11 and 12 show a shoe last structure **128*a* having a separate heel block 174 urged outwardly from the rear of the last structure by a pair of compression springs 176. One or more countersunk guide screws 178 may be provided to retain the block 174 in an aligned relationship with the last structure 128*a*. The heel block 174** is mannually held against the last structure when a shoe is applied thereto, and subsequently released to urge the shoe rearwardly as far as possible relative to the last structure.

FIGS. 13 and 14 illustrate a shoe last structure **128*b* having a heel block 180 similar to the heel block 174, but conected to the structure 128*b* by an elongated spring element 181 extending downwardly and rearwardly from a location adjacent to the top of the last structure. The spring element 180 is connected to the last structure 128*b* at its upper end by a screw 182 or other suitable means. When a shoe is positioned on the last structure 128*b*, the spring element 180** is held manually against the last structure by the operator. Once the shoe has been positioned, the spring element is released to urge the shoe rearwardly in a manner similar to that discussed above.

FIG. 15 illustrates a spring element 183 having an upper collar portion 185 connectible about the support rod 126 by a screw and nut arrangement 187. When in position about the support rod, a lower portion 189 of the spring element 183 extends downwardly therefrom, terminating at a location to the rear of the last structure 128 mounted to the support rod. The spring element 183 thus operates similarly to the spring element 181 of the last structure **128*b***, but extends upwardly beyond the last strucure to faciliate installation of boots on the last structure.

The details of the heater arrangement 16 and the related structure are shown most clearly in FIGS. 3, 16 and 17. The heater arrangement 16 generally comprises a heating element 184 having a plurality of parallel quartz tube heaters 186 therein. The upper surface of the heating element 184 comprises a protective layer 188 of asbestos or other thermally insulating material having a plurality of openings 190 for the passage of heat therethrough. The lower surface of the heating element comprises a metallic grate 191. The heating element 184 is positioned between a pair of spaced horizontal plates 192 and 194 of the lower housing 52, the upper surface of the plate 192 corresponding to the working surface 50 described above. The lower plate 194 is provided with an opening 196 above the drying tray 28 and a similar opening 198 above the press pad 44. The opening 196 permits heat to be transferred downwardly from the heating element 184 to the shoe within the tray 28, while the opening 198 permits downward heat transfer from the heating element in the second condition thereof as well as permitting passage of the press pad 44 upwardly therethrough.

As shown in FIGS. 16 and 17, the heating element 184 is mounted for transfer between the first and second locations thereof by a pair of collars 200 mounted to the inner end of the heating element and slidingly engaging a horizontal guide rod 202. A handle 204 is provided at the outer end of the heating element for manually sliding it in the direction indicated at 206 between the first and second locations.

As seen best in FIG. 16, the tray 28 is provided with a pair of slots 208 in the sidewalls thereof to engage a pair of retaining pins 210 and permit pivotal movement of the tray 28 from the lower broken line condition of FIG. 16 to the upper full line condition thereof. The slot 208 also permits the tray to be slid inwardly and outwardly relative to the pin 210 so that an outer end 212 of the tray can be urged inwardly and upwardly beyond a projection 214 of the housing 52 to place the tray in the raised condition. The tray can then be slid outwardly relative to the pins 210 such that the outer end 212 engages the projection 214, holding the tray in place. The shoe 24 can thus be easily inserted or withdrawn relative to the tray 28 when the tray is in the lower condition, and subsequently heated and dried by the heating element 184 when the tray is in the upper condition. A suitable handle 216 is provided for manual movement of the tray between these conditions.

Figure 18:
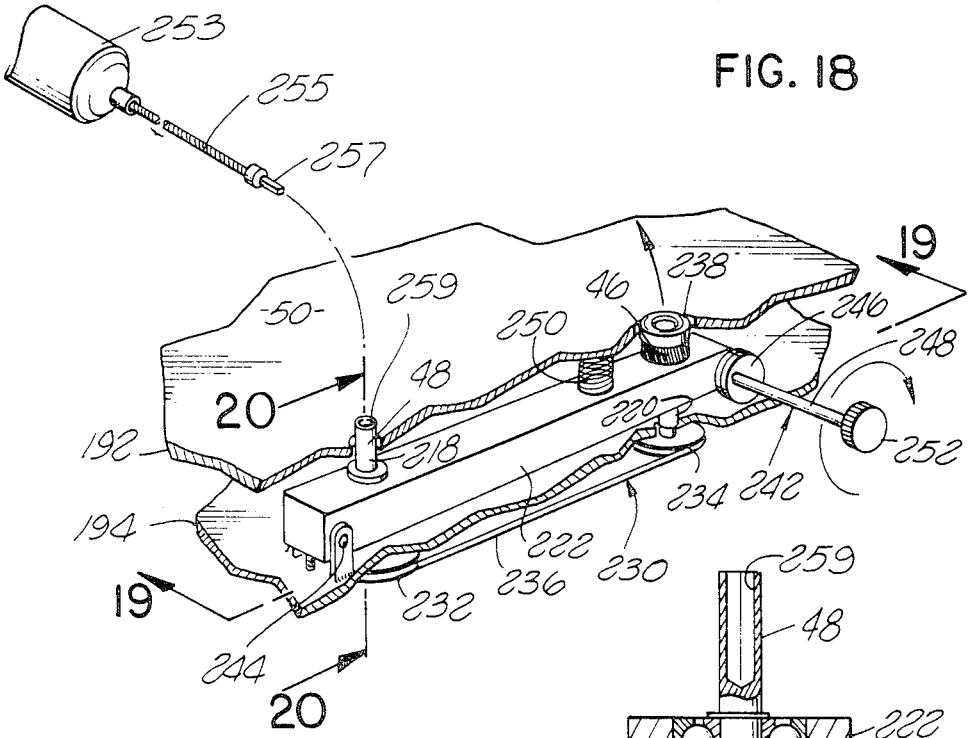
FIG. 18 is a fragmentary perspective view, partially broken away, illustrating the trimming mechanism of the apparatus of FIG. 1.
Figure 20:
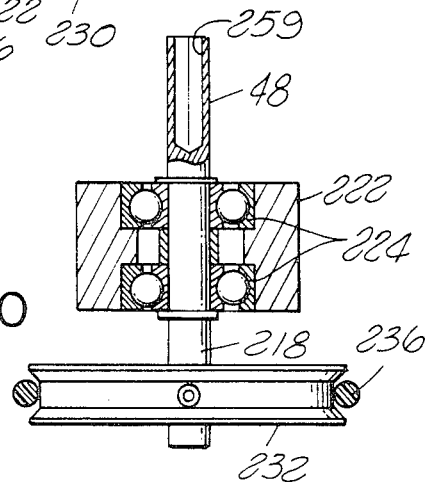
FIG. 20 is a vertical sectional view of the drive spindle of the mechanism of FIG. 18, taken along the line 20—20 thereof.
Figure 19:
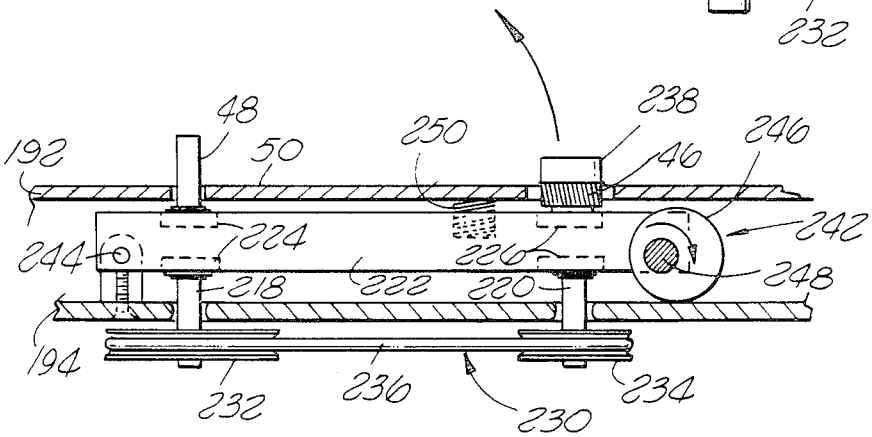
FIG. 19 is a vertical sectional view taken along the direction 19—19 of FIG. 18.

Referring now to FIGS. 18 through 20, the trimming mechanism 18 comprises a pair of parallel shafts 218 and 220 mounted for rotation relative to an elongated block element 222. The block element 222 is positioned between the horizontal plates 192 and 194 of the lower housing 52 such that the shafts 218 and 220 pass through the two plates. The shaft 218 and 220 are journaled within the block element 222 by pairs of bearing elements 224 and 226, respectively, and the rotary cutter 46 is carried for rotation at the upper end of the shaft 220. The upper end of the shaft 218 comprises the drive spindle 48, and the shafts 218 and 220 are connected for common rotation by a belt and pulley arrangement 230. The belt and pulley arrangement 230 comprises a first pulley 232 mounted to the lower end of the shaft 218, a second pulley 234 mounted to the lower end of the shaft 220 and a belt 236 passing between the pulleys. Rotation of the drive spindle 48 thus produces rotation of the cutter 46 to trim excess material from the wear portion of the shoe on the surface 50. A bearing 238 which is substantially coextensive with the cutter 46 is mounted to the top of the cutter for rotation relative thereto. The bearing 238 provides a surface for guiding the shoe 24 relative to the cutter 46 such that precisely the desired amount of material can be removed from the newly applied wear portion of the shoe without damage to the shoe itself.

The height of the cutter 46 relative to the working surface 50 is adjusted by pivotal movement of the block element 222 under the influence of a camming mechanism 242. The block element 222 is mounted for pivotal movement relative to the lower housing 52 about a horizontal axis 244, and is supported at its opposite end by a cam element 246 resting on the horizontal plate 194. The cam element 246 is mounted to an offset shaft 248 which is journaled within the block element 222. Continuous engagement of the cam element 246 with the horizontal plate 194 is assured by one or more compressive springs 250 urging the block element 222 downwardly from the plate 192. Rotation of the shaft 248 by a handle 252 thus pivots the block element 222 up or down, changing the corresponding height of the cutter 46 above the working surface. The cutter 46 is preferably adjusted to extend above the working surface 50 a distance just equal to the thickness of the newly applied wear portion 22. The bearing 238 will then ride along the portion of the shoe or the shoe sole directly above the wear portion 22, insuring an evenly trimmed surface.

As noted above, the drive spindle 48 can be connected to virtually any suitable drive means. For example, a portable motor 253 can be connected to the spindle 48 by the flexible drive element 255, or a motor assembly having a suitable opening can be placed directly over the spindle 48 such that the spindle engages the opening in a driving relationship. In the case of the flexible drive element 255, a square connector shaft 257 may be provided to engage a square bore 259 of the drive spindle.

The diameters of the pulleys 232 and 234 will, of course, be chosen to provide the desired rotational speed of the cutter 46 in light of the drive source used. It is preferable to have the cutter 46 rotate at approximately 3,000 revolutions per minute. In the embodiment shown in FIGS. 18 through 20, the pulley 232 is greater in diameter than the pulley 234, causing the cutter 46 to rotate faster than the spindle 48. This configuration is therefore designed for a motor having an operating speed somewhat less than 3,000 revolutions per minute.

A significant feature of the present invention is the variety of pad assemblies 20 available for supporting the wear portion 22 upon application to the shoe 24. Three forms of these pad assemblies are illustrated in FIGS. 21 through 24. The pad assembly of FIGS. 21 and 22, designated 254, is most useful as a heel pad for use in applying top lifts or heels to the shoe 24. The pad assembly 254 includes an upper portion 256 mounted for pivotal movement relative to a base portion 258. The upper portion and the base portion are provided with pairs of complementary ears 260 and 262, respectively, the ears being connected by a horizontal pivot pin 264. A resilient and heat resistant pad 266 overlies the upper portion 256 for engagement with the wear portion 22. One or more other resilient elements 268 are positioned between the upper portion 256 and the base portion 258 to bias the resilient pad 266 to a parallel configuration with the base portion. The resilient pad 266 and the resilient elements 268 can be retained in position relative to the upper portion 256 by bolt and nut assemblies 270 passing therethrough. The bolt and nut assemblies 270 may also act as stops to prevent pivoting of the upper portion 256 beyond a preselected limit.

The pad assembly 254 is preferably oriented relative to the shoe 24 such that the heel or other portion of the shoe to which a wear portion is to be applied is located directly above the axis of the pivot pin 264. The upper portion 256 will then pivot to an angle corresponding to that of the underside of the shoe when the wear portion is pressed against the shoe. Once the correct angle has been achieved, however, the pad assembly 254 will act as an essentially rigid member for the application of a substantially uniform force to the wear portion and the shoe. Any irregularities of the underside of the shoe will be accommodated by deformation of the resilient pad 266 to achieve a truly uniform application of force. For this purpose, the pad 266 is preferably formed of a material having substantial resistance to compression. A suitable material of this type would be a stiff foam material. The resilient elements 268 may have a somewhat lower resistance to compression to permit relatively free pivotal movement of the upper portion 256.

Figure 21:
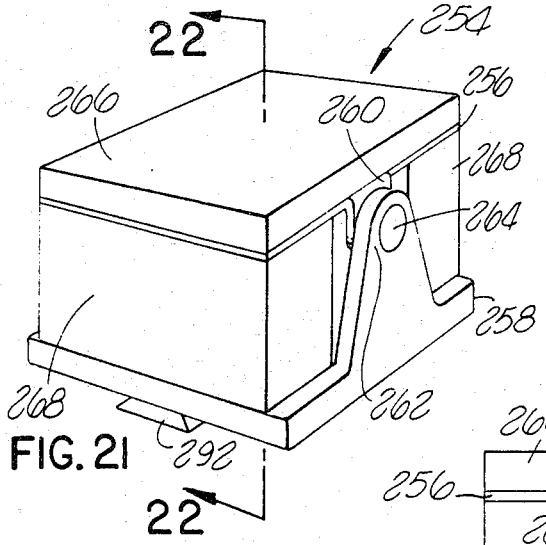
FIG. 21 is a perspective view of a heel or top lift pad assembly constructed in accordance with the present invention.
Figure 21A:
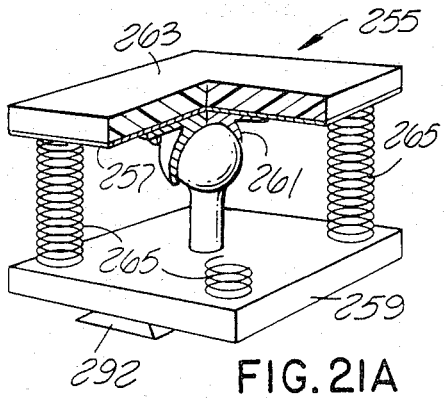
FIG. 21A is a perspective view partially broken away, of a heel or top lift pad assembly constructed in accordance with another embodiment of the present invention.
Figure 22:
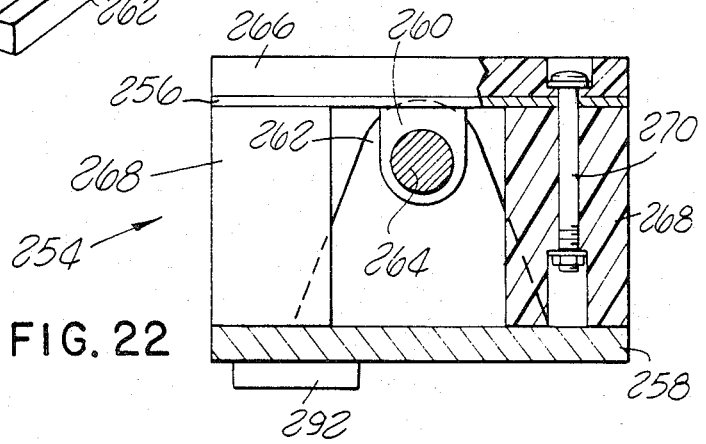
FIG. 22 is a side elevational view, partially broken away, of the heel pad assembly of FIG. 21.

An alternative form of pad assembly useful as a heel pad is illustrated in FIG. 21A at 255. The pad assembly 255 comprises an upper portion 257 supported over a base portion 259 by a ball-and-socket universal joint structure 261. A resilient and heat resistant pad 263 overlies the upper portion 257 for engagement with the wear portion 22, and one or more springs 265 are located between the upper portion and the base portion to bias them to a parallel condition.

The pad assembly 255 is used in much the same manner as the pad assembly 254. The pad assembly 255 is thus oriented relative to the shoe 24 such that the heel or other portion of the shoe requiring a new wear portion is located directly above the universal joint structure 261. The upper portion 257 can then conform to the orientation of the shoe heel when a new wear portion is pressed against the heel, producing a uniform application of force to the wear portion.

Figure 23:
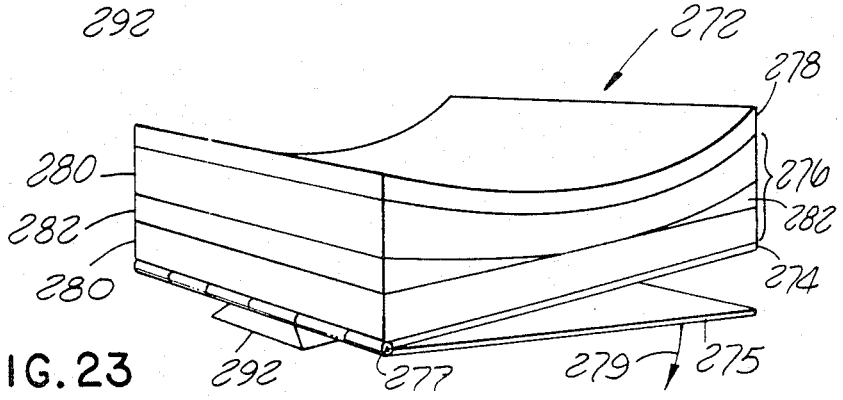
FIG. 23 is a perspective view of a sole pad constructed in accordance with one embodiment of the present invention.

Another form of pad assembly is shown at 272 in FIG. 23. The pad assembly 272 comprises a flat rigid base layer 274 located beneath a first composite resilient layer 276 and a second resilient layer 278. The composite layer 276 is made of a plurality of elements combining to form a layer of nonuniform thickness. The second resilient layer is preferably of uniform thickness and takes on the contour provided by the upper surface of the composite layer 276. The composite layer 276 comprises a pair of sheets 280 of uniform thickness sandwiching a pair of wedge portions 282 therebetween. The wedge portions 282 are positioned at opposite ends of the pad assembly 272 and are directed toward each other to give the upper surface of the pad assembly a concave contour. The various elements of the pad assembly 272 may be held together by any suitable means, such as adhesive.

A rigid plate 275 may, if desired, be connected to the base layer 274 by a hinge 277, such that the plate 275 is pivotable in the direction indicated at 279 from a position underlying the base layer 274.

The pad assembly 272 is designed primarily to be used in the application of a wear portion to the sole area of a shoe. The contour of the pad 272 is chosen to correspond generally to the contour of a particular type of shoe, any deviation from which is corrected for in the resilience of the layers 276 and 278. If the orientation of the pad 272 differs significantly from that of the shoe surface in a particular situation, the pad can simply be swung upwardly about the hinge 277 to a more suitable orientation. The plate 275 then remains in position against the press pad and a spacer (not shown) can be placed between the base layer 274 and the plate 275 to maintain the desired orientation. The layers 276 and 278 may be made of a foam material, with the layer 278 being substantially more compressible than the layer 276. The layer 276 is thus able to provide substantial support for the wear portion while it is applied to a shoe sole, and the layer 278 is relatively deformable to accommodate variations between individual shoe soles. The layer 278 is also preferably able to withstand high temperatures.

Figure 24:
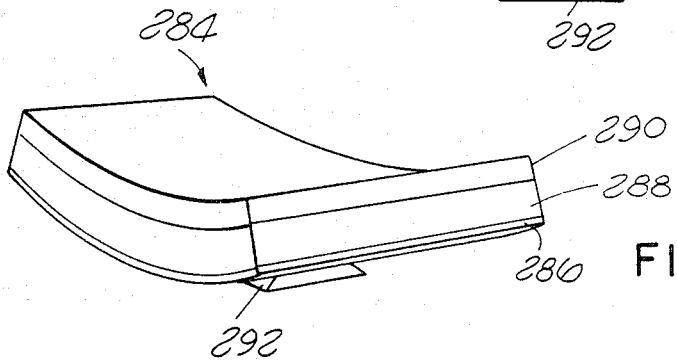
FIG. 24 is a perspective view of a sole pad constructed in accordance with a second embodiment of the present invention.

FIG. 24 illustrates a further pad assembly, generally designated 284. The pad assembly 284 comprises a curved rigid base layer 286, an intermediate stiff foam layer 288 and an upper compressible foam layer 290. The layers 286 through 290 are each of uniform thickness, with the curvature of the upper layer 290 being defined by that of the base layer 286. The various layers may be held together by any suitable means, such as an adhesive. The pad assembly 284 functions in essentially the same manner as the pad assembly 272.

The pad assemblies 254, 272 and 284 are each connectible to the upper surface of the press pad 44 to prevent undesired movement relative thereto. For this purpose, each of the press pads may be provided with a dovetail element 292 at the underside thereof for engagement with a dovetail groove 294 extending lengthwise down the center of the press pad 44 (FIGS. 1 and 25). The dovetail groove is provided with an expanded portion 296 at one end thereof for introduction and withdrawal of the dovetail elements 292 relative to the groove. A particular pad assembly and the dovetail element 292 carried thereby is retained at a desired location along the groove 294 by friction. The operator can thus adjust the longitudinal position of a pad assembly on the press pad 44, and the pad assembly will thereafter remain at that position during the application of a wear portion to a shoe.

In operation, the underside of a shoe is initially inspected and cleaned to prepare it for the application of a wear portion. The shoe may then be placed within the tray 28 for drying of the shoe and heating of its underside to facilitate removal of any wear poriton previously applied thereto. At this time, the heater 184 is positioned at the first location above the drying tray 28. After drying, the shoe is mounted to the shoe mounting arrangement 12 by fitting the shoe over the appropriate shoe last structure 28. For this purpose, the support rod 126 carrying the shoe last structure is preferably pivoted outwardly to the broken line condition of FIG. 8. The support rod 126 is then returned to the vertical condition and the nut 150 is advanced upwardly on the threaded shaft 144 to lock the support rod in place. If necessary, the support rod is rotated relative to the threaded shaft 144 to achieve a preselected height of the shoe above the working surface 50. The desired pad assembly 254, 272 or 284, is then mounted to the press pad 44 and the appropriate wear portion 22 is placed thereon. At this time, the press pad 44 is raised to place the wear portion 22 adjacent the underside of the shoe 24, permitting accurate alignment of the wear portion. The press pad 44 is then retracted to the full line condition of FIG. 4 and the heating element 184 is moved to the second location. The heating element is then activated for a preselected length of time to melt the adhesive and heat the underside of the shoe. The protective layer 188 at the upper surface of the heating element limits the amount of heat transferred upwardly to the underside of the shoe to a value significantly lower than that passed downwardly to the wear portion 22. Therefore, sufficient heating of the wear portion can be achieved without damaging the shoe itself. After heating, the heating element is returned to the first location and the mechanism 14 is actuated through sequential depression of the foot pedals 26 and 27 to raise the wear portion 22 and urge it tightly against the underside of the shoe 24. After a preselected press period, the actuating mechanism is released and the shoe 24 is removed from the last structure 128. The excess material of the wear portion is then trimmed from the shoe by attaching the motor 253 to the spindle 48 and sliding the shoe along the working surface 50 in contact with the rotary cutter 46. After the shoe has been trimmed, the edge of the sole and the newly applied wear portion may be colored with a suitable shoe wax to yield a more pleasing and uniform appearance.

The apparatus 10 is preferably constructed to occupy no more than three square feet of floor space and be approximately 10 feet tall. An upper portion 297 of the apparatus 10, shown in FIG. 1, may comprise a fuse block 298, a pair of timers 300 and 302, indicator lights 303, a plurality of bins 304 for storing wear portions of the type to be applied to shoe soles, and a rack 306 for storing different wear portions 22 for use as shoe heels or top lifts.

The timers 300 and 302 are adapted to provide preselected levels of electric power to the heating element 184 of the heater arrangement 16 for the time periods described above. Thus the timers 300 and 302 are each capable of providing a first level of electric power to the heating element for approximately 10 seconds to produce an intense level of heat, followed by a second lower level of power for a longer period. The first and second power levels may be adjustable to produce optimal results with different shoe and adhesive materials, and the latter period is adjustable between one and two minutes. These parameters are preferably chosen to maintain the underside of the shoe at approximately 90° Celsius for approximately one minute when the heating element is in the first location over the drying tray 28 (timer 300), and to maintain the adhesive coating at a melting temperature of approximately 180° Celsius for as long as two minutes (timer 302).

The appended claims are intended to cover all variations and adaptations falling within the true scope and spirit of the present invention.

What is claimed is:

1. Apparatus for applying a wear portion to the underside of a shoe, comprising:

means for receiving a shoe;

means for locating an adhesive-coated wear portion in an initial position relative to the shoe, with the adhesive coating essentially opposite to and spaced from the underside of the shoe, including an actuating element carrying the wear portion and mounted for reciprocal movement toward and away from the shoe receiving means;

means for heating the wear portion in said initial position;

means for applying a first pressure to urge the actuating element and the shoe receiving means toward each other and urge the wear portion and the shoe together, said first pressure means comprising first lever means and means for transmitting tensile forces from the first lever means to the actuating element; and means for applying a second pressure in situ through the force transmitting means to further urge the wear portion and the underside of the shoe together, the second pressure being greater than the first pressure.

2. The apparatus recited in claim 1 wherein the first pressure means and the second pressure means are manually operated.

3. The apparatus recited in claim 1 wherein the actuating element is mounted for sliding movement toward and away from the shoe receiving means.

4. The apparatus recited in claim 1 wherein the first lever means is actuable by a foot pedal.

5. The apparatus recited in claim 1 wherein the force transmitting means comprises at least one flexible force transmitting member operatively connected at one end thereof to the locating means.

6. The apparatus recited in claim 7 wherein the second pressure means includes means for deflecting a portion of the flexible force transmitting member laterally from a substantially linear tensioned condition to urge the actuating element and the shoe receiving means together.

7. The apparatus recited in claim 1 which includes means for locking the first lever means in position after the actuating element and the shoe receiving means have been brought together by the first pressure means.

8. The apparatus in claim 1 wherein the flexible force transmitting member extends from said one end to a second end, the first lever means acting on the second end.

9. The apparatus recited in claim 1 wherein the wear portion and the underside of the shoe are located in substantially parallel planes in said initial position and the first pressure means comprises means for urging the actuating element and the shoe receiving means toward each other in a direction substantially normal to the substantially parallel planes.

10. The apparatus recited in claim 1 wherein the shoe receiving means comprises means for holding the shoe in a stationary upright condition during application of the wear portion.

11. The apparatus recited in claim 1 which includes structural support means and further comprises means for trimming the wear portion after it is applied to the shoe, the trimming means comprising:

an outer working surface mounted to the structural support means;

rotary cutter means extending at least partially through the working surface in an outward direction for engagement with the wear portion of a shoe positioned on the surface;

means for mounting the cutter means for rotation relative to the working surface; and means for connecting a rotary drive source to the cutter means.

12. The apparatus recited in claim 11 wherein the means for mounting the cutter means comprises frame means supported by the structural support means at a location beneath said outer surface, and first shaft means mounted for rotation within the frame means and carrying the cutter means.

13. The apparatus recited in claim 12 wherein the means for mounting the cutter means includes means for adjusting the position of the cutter means relative to the working surface in a direction substantially normal to the working surface.

14. The apparatus recited in claim 13 wherein the frame means is mounted for pivotal movement relative to an axis spaced from the first shaft means and substantially parallel to said outer working surface.

15. Apparatus for applying a wear portion to the underside of a shoe, comprising:

means for receiving a shoe;

means for locating an adhesive-coated wear portion in an initial position relative to the shoe, with the adhesive coating essentially opposite to and spaced from the underside of the shoe, said locating means being movable from said initial position toward the shoe receiving means;

means for heating the wear portion in said initial position;

means for applying a first pressure to actuate the locating means toward the shoe receiving means and urge the wear portion and the shoe together, said first pressure means comprising first lever means and at least one flexible force transmitting member extending from a first end connected to the locating means to a second end which is held stationary and the first lever means being constructed and arranged to engage the flexible force transmitting member between said one end and said second end to decrease the effective length thereof; and means for applying a second pressure in situ to further urge the wear portion and the underside of the shoe together, the second pressure being greater than the first pressure.

16. The apparatus recited in claim 15, wherein the first lever means comprises rotatable means for engaging the flexible force transmitting member.

17. The apparatus recited in claim 10 wherein the flexible force transmitting member comprises a chain and the rotatable means comprises an idler sprocket.

18. Apparatus for applying a wear portion to the underside of a shoe, comprising:

means for receiving a shoe;

means for locating an adhesive-coated wear portion in an initial position relative to the shoe, with the adhesive coating essentially opposite to and spaced from the underside of the shoe, said locating means being movable from said initial position toward the shoe receiving means;

means for heating the wear portion in said initial position;

means for applying a first pressure to actuate the locating means toward the shoe receiving means and urge the wear portion and the shoe together, said first pressure means comprising first lever means and at least one flexible force transmitting member operatively connected at one end thereof to the locating means for transmitting tensile forces from the first lever means to the locating means;

ratchet means for locking the first lever means in position after the actuating element and the shoe receiving means have been brought together by the first pressure means; and means for applying a second pressure in situ to further urge the wear portion and the underside of the shoe together, the second pressure being greater than the first pressure.

19. Apparatus for applying a wear portion to the underside of a shoe, comprising:

means for receiving a shoe;

means for locating an adhesive-coated wear portion in an initial position relative to the shoe, with the adhesive coating essentially opposite to and spaced from the underside of the shoe;

means for heating the wear portion in said initial position;

means for applying a first pressure to actuate the locating means and the shoe receiving means toward each other and urge the wear portion and the shoe together, said first pressure means comprising first lever means and at least one flexible force transmitting member operatively connected at one end thereof to the locating means for transmitting tensile forces from the first lever means to the locating means; and means for applying a second pressure in situ to further urge the wear portion and the underside of the shoe together, the second pressure being greater than the first pressure and the second pressure means including second lever means actuable to deflect a portion of the flexible force transmitting member laterally from a substantially linear tensioned condition.

20. The apparatus recited in claim 19 wherein the first and second lever means are actuable by independent foot pedals.

21. Apparatus for applying a wear portion to the underside of a shoe, comprising:

means for receiving a shoe;

means for locating an adhesive-coated wear portion in an initial position relative to the shoe, with the adhesive coating essentially opposite to and spaced from the underside of the shoe, said locating means being movable from said initial position toward the shoe receiving means;

means for heating the wear portion in said initial position;

means for applying a first pressure to actuate the locating means toward the shoe receiving and urge the wear portion and the shoe together, said first pressure means comprising first lever means and at least one flexible force transmitting member operatively connected at one end thereof to the locating means, the first lever means being constructed and arranged to engage the flexible force transmitting member at a location remote from said one end to apply tensile forces acting on the locating means; and means for applying a second pressure in situ to further urge the wear portion and the underside of the shoe together, the second pressure being greater than the first pressure;

the second pressure means comprising:

second lever means having first and second end portions; and rotatable means mounted to the first end portion for guiding the flexible force transmitting member as it is tensioned by the first lever means;

the second lever means being actuable to effectively shorten the flexible member by altering the location of the rotable means.

22. The apparatus recited in claim 21 wherein the flexible force transmitting member comprises a chain and the rotatable means comprises an idler sprocket.

23. Apparatus for applying a wear portion to the underside of a shoe, comprising:

means for receiving a shoe, including anvil means, shoe last means and means for mounting the shoe last means to the anvil means in a stationary upright condition to resist upward forces;

means for locating an adhesive-coated wear portion in an initial position relative to the shoe, with the adhesive coating essentially opposite to and spaced from the underside of the shoe;

means for heating the wear portion in said initial position;

means for applying a first pressure to actuate the locating means and the shoe receiving means toward each other and urge the wear portion and the shoe together; and means for applying a second pressure in situ to further urge the wear portion and the underside of the shoe together, the second pressure being greater than the first pressure.

24. The apparatus recited in claim 23 wherein the shoe last means is mounted for sliding adjustment relative to the anvil means in a horizontal direction.

25. The apparatus recited in claim 23 wherein the mounting means includes elongated support means depending from the anvil means and carrying the shoe last means at a lower end thereof, the elongated support means being mounted for pivotal movement relative to the anvil means between the stationary upright condition of the shoe last means and a second condition in which the shoe last means is swung outwardly therefrom.

26. The apparatus recited in claim 24 wherein said shoe last means comprises a plurality of shoe lasts which are interchangeably mountable to the support means.

27. The apparatus recited in claim 23 wherein the shoe last means has a toe portion and a heel portion, and wherein the shoe receiving means further comprises spring-urged means extending rearwardly relative to the heel portion to engage the interior of a shoe positioned on the shoe last means and draw the shoe securely over the toe portion.

28. The apparatus recited in claim 26 wherein the spring-urged means comprises at least one heel block spring-mounted to said heel portion.

29. The apparatus recited in claim 26 wherein the spring-urged means comprises at least one elongated spring element extending generally downwardly and rearwardly from a location above the shoe last means and terminating at a location to the rear of the heel portion.

30. The apparatus recited in claim 23 wherein the shoe last means has a toe portion and a heel portion, and wherein the shoe receiving means further comprises at least one resilient strap element forming a loop which extends from the mounting means to engage the shoe and draw it securely over the toe portion.

31. Apparatus for applying a wear portion to the underside of a shoe, comprising:

means for receiving a shoe;

means for locating an adhesive-coated wear portion in an initial position relative to the shoe, with the adhesive coating essentially opposite to and spaced from the underside of the shoe;

means for heating the wear portion in said initial position, the heating means comprising a heating element which is transferable between first and second positions and is positioned between and substantially parallel to the underside of the shoe and the wear portion in the second position of the heating element and the initial position of the locating means;

actuating means for bringing the locating means and the shoe receiving means together at a first condition of leverage to cause the adhesive coating to substantially abut the underside of the shoe, and thereafter urging the locating means and the shoe receiving means together at a second condition of leverage which is greater than the first condition of leverage; and means for heating a shoe before it is placed on the shoe receiving means, comprising tray means for holding the shoe and exposing it to the heating element when the heating element is in the first position thereof.

32. The apparatus recited in claim 31 wherein the heating means comprises handle means for manually transferring the heating element between the first and second positions.

33. The apparatus recited in claim 32 wherein the heating means comprises means for guiding the heating element between the first and second positions.

34. The apparatus recited in claim 33 wherein the guiding means comprises a guide rod mechanism for guiding and at least partially supporting the heating element between the first and second positions.

35. The apparatus recited in claim 34 wherein the guiding means is located adjacent one end of the heating element and the handle means is located at the other end of the heating element.

36. The apparatus recited in claim 31 wherein the tray means is located below the heating element in the first position thereof and is actuable between a lowered condition permitting access to a shoe therein and a raised condition in which the shoe is located closer to the heating element.

37. Apparatus for applying a wear portion to the underside of a shoe, comprising:

means for receiving a shoe;

means for locating an adhesive-coated wear portion in an initial position relative to the shoe, with the adhesive coating essentially opposite to and spaced from the underside of the shoe;

means for heating the wear portion in said initial position, the heating means comprising:

a heating element which is transferable between first and second positions and is positioned between and substantially parallel to the underside of the shoe and the wear portion in the second position of the heating element and the initial position of the locating means; and protective means carried with the heating element to avoid contact of a user's hands with the heating element, the protective means defining a plurality of openings permitting the passage of heat therethrough; and actuating means for bringing the locating means and the shoe receiving means together at a first condition of leverage to cause the adhesive coating to substantially abut the underside of the shoe, and thereafter urging the locating means and the shoe receiving means together at a second condition of leverage which is greater than the first condition of leverage.

38. The apparatus recited in claim 37 wherein the protective means is made of asbestos.

39. The apparatus recited in claim 37 wherein the heating element comprises a plurality of quartz heating tubes.

40. Apparatus for applying a wear portion to the underside of a shoe, comprising:
means for receiving a shoe;
means for locating an adhesive-coated wear portion in an initial position relative to the shoe with the adhesive coating essentially opposite to and spaced from the underside of the shoe, the locating means comprising:
a pad assembly for supporting the adhesive-coated wear portion in said initial position;
an actuator plate for transmitting force to the pad assembly; and
means for detachably mounting the pad assembly to the actuator plate, including projection means extending downwardly from the pad assembly and means for receiving the projection means within the actuator plate;
means for heating the wear portion in said initial position;
means for applying a first pressure to actuate the locating means and the shoe receiving means toward each other and urge the wear portion and the shoe together; and
means for applying a second pressure in situ to further urge the wear portion and the underside of the shoe together, the second pressure being greater than the first pressure.

41. The apparatus recited in claim 40 wherein the means for receiving the projection means defines an undercut groove.

42. The apparatus recited in claim 41 wherein the projection means is a dovetail element and the undercut groove is a dovetail groove.

43. Apparatus for applying a wear portion to the underside of a shoe, comprising:
means for receiving a shoe;
means for locating an adhesive-coated wear portion in an initial position relative to the shoe, with the adhesive coating essentially opposite to and spaced from the underside of the shoe;
means for heating the wear portion in said initial position;
means for applying a first pressure to actuate the locating means and the shoe receiving means toward each other and urge the wear portion and the shoe together;
means for applying a second pressure in situ to further urge the wear portion and the underside of the shoe together, the second pressure being greater than the first pressure; and
means for trimming the wear portion after it is applied to the shoe, comprising:
an outer working surface mounted to the structural support means;
rotary cutter means extending at least partially through the working surface in an outward direction for engagement with the wear portion of a shoe positioned on the surface;
means for mounting the cutter means for rotation relative to the working surface;
means for connecting a rotary drive source to the cutter means; and
bearing means concentric with the cutter means and located outwardly therefrom, the bearing means engaging the shoe at a location above the wear portion to guide the shoe relative to the cutter means as the cutter means rotates.

44. The apparatus recited in claim 43 wherein the bearing means is freely rotatable relative to the cutter means.

45. The apparatus recited in claim 44 wherein the bearing means is essentially coextensive in a radial direction with the cutter means.

46. The apparatus recited in claim 45 wherein the bearing means is mounted to the cutter means.

47. Apparatus for applying a wear portion to the underside of a shoe, comprising:
structural support means;
means for receiving a shoe;
means for locating an adhesive-coated wear portion in an initial position relative to the shoe, with the adhesive coating essentially opposite to and spaced from the underside of the shoe;
said receiving means and said locating means being associated with the structural support means;
means for heating the wear portion in said initial position;
means for applying a first pressure to actuate the locating means and the shoe receiving means toward each other and urge the wear portion and the shoe together;
means for applying a second pressure in situ to further urge the wear portion and the underside of the shoe together, the second pressure being greater than the first pressure; and
means for trimming the wear portion after it is applied to the shoe, comprising:
an outer working surface of the structural support means;
rotary cutter means extending at least partially through the working surface in an outward direction for engagement with the wear portion of a shoe positioned on the surface;
means for mounting the cutter means for rotation relative to the working surface, comprising;
frame means supported by the structural support means at a location beneath said outer working surface;
first shaft means mounted for rotation within the frame means to carry the cutter means;
means for adjusting the position of the cutter means relative to the working surface in a direction substantially normal to the working surface;
the frame means being mounted for pivotal movement about an axis spaced from the first shaft means and substantially parallel to the outer working surface, and being biased downwardly away from the working surface; and
the adjusting means including means for camming the frame means upwardly; and
means for connecting a rotary drive source to the cutter means.

48. The apparatus recited in claim 47 wherein the camming means includes a shaft journaled within the frame means and a cam element carried by the shaft, the cam element engaging the structural support means in a camming relationship.

49. The apparatus recited in claim 48 which includes a knob for rotatably adjusting said shaft and the cam element.

50. Apparatus for applying a wear portion to the underside of a shoe, comprising:
structural support means;
means for receiving a shoe;

means for locating an adhesive-coated wear portion in an initial position relative to the shoe, with the adhesive coating essentially opposite to and spaced from the underside of the shoe;

said receiving means and said locating means being associated with the structural support means;

means for heating the wear portion in said initial position;

means for applying a first pressure to actuate the locating means and the shoe receiving means toward each other and urge the wear portion and the shoe together;

means for applying a second pressure in situ to further urge the wear portion and the underside of the shoe together, the second pressure being greater than the first pressure; and means for trimming the wear portion after it is applied to the shoe, comprising:

an outer working surface mounted to the structural support means;

rotary cutter means extending at least partially through the working surface in an outward direction for engagement with the wear portion of a shoe positioned on the surface;

means for mounting the cutter means for rotation relative to the working surface, including frame means supported by the structural support means at a location beneath said outer working surface and first shaft means mounted for rotation within the frame means to carry the cutter means; and means for connecting a rotary drive source to the cutter means comprising:

second shaft means mounted for rotation within the frame means and terminating in an upper end extending through the outer working surface;

belt and pulley means carried by the first and second shaft means, respectively; and connector means for releasably engaging a rotary drive source with the upper end of the second shaft means.

51. The apparatus recited in claim 50 wherein the means for connecting a rotary drive source includes a flexible drive means engageable with the connector means.

52. The apparatus recited in claim 51 wherein the connector means comprises a connector shaft of square cross-section.

53. The apparatus recited in claim 50 wherein the belt and pulley means are constructed and arranged to gear the first shaft means up relative to the second shaft means.

54. A mechanism for applying an adhesive-coated wear portion to the underside of a shoe, comprising:

means for receiving a shoe;

means for supporting an adhesive-coated wear portion, including an actuating element carrying the wear portion and mounted for reciprocal movement toward and away from the shoe receiving means;

means for applying a first preselected pressure to urge the wear portion and the shoe together, said first pressure means comprising first lever means and means for transmitting tensile forces from the first lever means to the actuating element; and means for applying a second preselected pressure in situ through the force transmitting means to urge the wear portion and the shoe together, the second pressure being greater than the first pressure.

55. The mechanism recited in claim 54 wherein the means for applying a first pressure and the means for applying a second pressure are manually operated.

56. The mechanism recited in claim 54 wherein the actuating element is mounted for sliding movement toward and away from the shoe receiving means.

57. The mechanism recited in claim 54 wherein the force transmitting means comprises at least one flexible force transmitting member operatively connected at one end thereof to the supporting means.

58. The mechanism recited in claim 57 wherein the second pressure means includes means for deflecting a portion of the flexible force transmitting member laterally from a substantially linear tensioned condition to urge the locating means and the shoe receiving means together.

59. The mechanism recited in claim 57 wherein the supporting means is mounted for movement from said initial position toward the shoe receiving means, and the first lever means engages the flexible force transmitting member at a location remote from said one end to apply tensile forces tending to draw the one end and the supporting means toward the shoe receiving means.

60. The mechanism recited in claim 59 which includes means for locking the first lever means in position after the supporting means and the shoe receiving means have been brought together by the first pressure means.

61. The mechanism recited in claim 59 wherein the flexible force transmitting member extends from said one end to a second end, the first lever means acting on the second end.

62. A mechanism for applying an adhesive coated wear portion to the underside of a shoe, comprising:

means for receiving a shoe;

means for supporting an adhesive-coated wear portion in an initial position, said supporting means being mounted for movement from said initial position toward the shoe receiving means;

means for applying a first preselected pressure to urge the wear portion and the shoe together, said first pressure means comprising:

first lever means; and at least one flexible force transmitting member extending from one end operatively connected to the supporting means to a second end which is held stationary;

said first lever means engaging the flexible transmitting member between said one end and said second end to decrease the effective length of the force transmitting member and draw the one end and the supporting means toward the shoe receiving means; and means for applying a second preselected pressure in situ through the force transmitting member to further urge the wear portion and the shoe together, the second pressure being greater than the first pressure.

63. The mechanism recited in claim 62 wherein the first lever means comprises rotatable means for engaging the flexible force transmitting member.

64. A mechanism for applying an adhesive coated wear portion to the underside of a shoe, comprising:

means for receiving a shoe;

means for supporting an adhesive-coated wear portion in an initial position, said supporting means being mounted for movement from said initial position toward the shoe receiving means;

means for applying a first preselected pressure to urge the wear portion and the shoe together, said first pressure means comprising:

first lever means; and at least one flexible force transmitting member operatively connected at one end thereof to the supporting means;

said first lever means engaging the flexible force transmitting member at a location remote from said one end to apply tensile forces tending to draw the one end and the supporting means toward the shoe receiving means;

means for applying a second preselected pressure in situ through the flexible force transmitting member to further urge the wear portion and the shoe together, the second pressure being greater than the first pressure and the second pressure means comprising:

second lever means having first and second end portions; and rotatable means mounted to the first end portion for guiding the flexible force transmitting member as it is tensioned by the first lever means;

the second lever means being actuable to effectively shorten the flexible member by altering the location of the rotatable means.

65. The apparatus recited in claim 64 wherein the flexible force transmitting member comprises a chain and the rotatable means comprises an idler sprocket.

66. A mechanism for applying an adhesive coated wear portion to the underside of a shoe, comprising:

means for receiving a shoe;

means for supporting an adhesive-coated wear portion in an initial position, said supporting means being mounted for movement from said initial position toward the shoe receiving means;

means for applying a first preselected pressure to urge the wear portion and the shoe together, said first pressure means comprising:

first lever means;

at least one flexible force transmitting member operatively connected at one end thereof to the supporting means;

said first lever means engaging the flexible force transmitting member at a location remote from said one end to apply tensile forces tending to draw the one end and the supporting means toward the shoe receiving means;

ratchet means for locking the first lever means in position after the supporting means and the shoe receiving means have been brought together by the first pressure means; and means for applying a second preselected pressure in situ through the force transmitting member to further urge the wear portion and the shoe together, the second pressure being greater than the first pressure.

67. A mechanism for applying an adhesive coated wear portion to the underside of a shoe, comprising:

means for receiving a shoe;

means for supporting an adhesive-coated wear portion in an initial position, said supporting means being mounted for movement from said initial position toward the shoe receiving means;

means for applying a first preselected pressure to urge the wear portion and the shoe together, said first pressure means comprising:

first lever means; and at least one flexible force transmitting member operatively connected at one end thereof to the supporting means to transmit tensile forces from the first lever means to the supporting means;

means for applying a second preselected pressure in situ to further urge the wear portion and the shoe together, the second pressure being greater than the first pressure and the second pressure means comprising second lever means actuable to deflect a portion of the flexible force transmitting member laterally from a substantially linear tensioned condition to urge the supporting means and the shoe receiving means together.

* * * * *